US011819724B2

(12) United States Patent
Allen

(10) Patent No.: US 11,819,724 B2
(45) Date of Patent: Nov. 21, 2023

(54) AQUATIC EXERCISE EQUIPMENT ASSEMBLY AND METHOD OF USE THEREOF

(71) Applicant: Arthoaquatic Fitness System, Inc., Detroit, MI (US)

(72) Inventor: Chris Allen, Detroit, MI (US)

(73) Assignee: Arthoaquatic Fitness System, Inc., Detroit, MI (US)

( * ) Notice: Subject to any disclaimer, the term of this patent is extended or adjusted under 35 U.S.C. 154(b) by 0 days.

(21) Appl. No.: 17/990,007

(22) Filed: Nov. 18, 2022

(65) Prior Publication Data

US 2023/0079639 A1 Mar. 16, 2023

Related U.S. Application Data

(63) Continuation of application No. 17/349,077, filed on Jun. 16, 2021, now Pat. No. 11,529,539.

(51) Int. Cl.

| | |
|---|---|
| ***A63B 21/008*** | (2006.01) |
| ***A63B 22/06*** | (2006.01) |
| ***A63B 21/06*** | (2006.01) |

(52) U.S. Cl.

CPC ..... *A63B 21/0084* (2013.01); *A63B 21/0615* (2013.01); *A63B 22/0605* (2013.01); *A63B 2022/0611* (2013.01); *A63B 2208/0228* (2013.01); *A63B 2208/03* (2013.01); *A63B 2225/60* (2013.01)

(58) Field of Classification Search

CPC ..... A63B 21/0084; A63B 21/0615; A63B 22/0605; A63B 2022/0611; A63B 2208/0228; A63B 2208/03; A63B 2225/60

See application file for complete search history.

(56) References Cited

U.S. PATENT DOCUMENTS 964,886 A * 7/1910 Sickels ..... A63B 69/10 482/56
1,966,448 A * 7/1934 Kabisius ..... A63B 69/10 434/254

(Continued)

OTHER PUBLICATIONS

"HydroWorx 750 Athletic Rehabilitation Aquatic Therapy Pool" available Feb. 24, 2019, [online], [site visited Feb. 24, 2019] Available from internet, <URL:https//www.hydroworx.com/products/hydroworx-750/> (2019).

(Continued)

*Primary Examiner* — Garrett K Atkinson
(74) *Attorney, Agent, or Firm* — Dinsmore & Shohl LLP

(57) ABSTRACT

Embodiments herein are directed to an aquatic exercising assembly. The aquatic exercising assembly includes a container having a liquid retention portion. The liquid retention portion includes a bottom wall, a pair of opposing sidewalls, and a pair of opposing end walls, a pedal assembly and a paddle assembly. The pedal assembly is rotatably coupled to the one of the pair of opposing end walls. The paddle assembly is coupled to each one of the pair of opposing sidewalls. The paddle assembly is movable between a rearward position and a forward position in a longitudinal direction. The pedal assembly is rotatably moved by a lower body movement of a user and the paddle assembly is moved by an upper body movement of the user.

19 Claims, 15 Drawing Sheets

(56) References Cited

U.S. PATENT DOCUMENTS 4,599,835 A 7/1986 Rinke
4,631,037 A * 12/1986 Dickens ..... B63H 16/20 440/90
4,828,522 A * 5/1989 Santos ..... B63B 34/565 441/132
5,183,422 A * 2/1993 Guiboche ..... B63H 16/12 440/26
5,316,532 A * 5/1994 Butler ..... A63B 22/0605 482/57
5,338,275 A * 8/1994 Chek ..... A63B 21/0084 441/64
5,366,426 A * 11/1994 Glavin ..... A63B 21/4031 482/142
5,368,507 A * 11/1994 Harris ..... B63H 16/12 440/95
D356,164 S 3/1995 Rinke
5,487,713 A * 1/1996 Butler ..... A63B 71/0009 482/57
5,586,961 A * 12/1996 Quint ..... A63B 22/02 482/73
5,690,588 A * 11/1997 Lavore ..... A63B 21/00069 482/111
5,752,899 A * 5/1998 Ballard ..... A63B 21/0084 482/111
6,135,835 A * 10/2000 Lekhtman ..... B63H 16/20 114/347
D449,895 S 10/2001 Wilson
6,543,191 B1 4/2003 Kress
6,764,431 B2 * 7/2004 Yoss ..... A63B 69/10 434/254
D548,898 S 8/2007 Northrop et al.
7,520,841 B2 * 4/2009 Ho ..... A63B 22/0056 482/53
8,074,304 B1 * 12/2011 Snyder ..... A61H 33/60 4/496
9,051,038 B1 * 6/2015 Herber ..... B63H 16/18
9,056,220 B2 * 6/2015 Richards ..... A63B 21/00069
9,403,585 B2 * 8/2016 Arad ..... B63H 16/20
D800,852 S 10/2017 Flook
D820,922 S 6/2018 Saragoni et al.
2008/0103029 A1 * 5/2008 De Figueiredo Silva ..... A63B 21/008 482/58
2010/0317493 A1 * 12/2010 Chen ..... A63B 69/16 482/61

OTHER PUBLICATIONS

"TSG Medical, Physical_therapy_device_Ladder_for_rehabilitation_training" available Feb. 24, 2019 [online], [site visited Feb. 24, 2019] Available from internet, <URL:http://www.tsgmedicalsupply.com/sale-9088141-physical-therapy-device-ladder-for-rehabilitation-training.html> (2019).
"Ruse Sports, Rehabilitation Ladder with different height of the steps on both sides" available Feb. 24, 2019 [online], [site visited Apr. 30, 2021] Available from internet, <URL:https://www.ruse-sport.com/produkt/st-lbichka-za-rehabilitacija/> (2019).
Chris Allen, Design U.S. Appl. No. 29/620,198 for "Water Fitness Equipment", filed Aug. 11, 2016.
"Chris Allen Arthritis" https://www.youtube.com/watch?v=dqut0fKI69I [online] Nov. 17, 2009.

* cited by examiner

AQUATIC EXERCISE EQUIPMENT ASSEMBLY AND METHOD OF USE THEREOF

CROSS-REFERENCE TO RELATED APPLICATIONS

This utility patent application is a continuation of co-pending U.S. patent application Ser. No. 17/349,077 filed Jun. 16, 2021, the entire contents of which is incorporated herein in its entirety.

TECHNICAL FIELD

The present specification generally relates to an underwater (aquatic) exercise equipment assembly and, more specifically to an aquatic exercise equipment assembly that provides a paddle assembly for an upper body movement and a pedal assembly for a lower body movement.

BACKGROUND

In the exercise and fitness field, there are various known devices to assist users to exercise and maintain physical fitness. Further, it is known that aquatic therapeutic rehabilitation equipment is used for assisting physical therapists in rehabilitating persons or assisting in physical fitness. Water provides an environment that reduces a body weight of the user thereby decreasing musculoskeletal stress or impact on the body. As such, soreness of the user may be reduced following the exercise or fitness. However, these known aquatic devices generally do not provide the user with a full body workout. Further, these known aquatic devices do not cater to those with underlying conditions, such as those suffering from arthritis, acute injuries, neurological disorders, stroke symptoms, and the like.

Accordingly, a need exists for alternative aquatic exercise equipment assemblies that provide the user with a full body workout and that assist those with underlying conditions.

SUMMARY

In one embodiment, an aquatic exercising assembly is provided. The aquatic exercising assembly includes a container having a liquid retention portion. The liquid retention portion includes a bottom wall, a pair of opposing sidewalls, and a pair of opposing end walls, a pedal assembly and a paddle assembly. The pedal assembly is rotatably coupled to the one of the pair of opposing end walls. The paddle assembly is coupled to each one of the pair of opposing sidewalls. The paddle assembly is movable between a rearward position and a forward position in a longitudinal direction. The pedal assembly is rotatably moved by a lower body movement of a user and the paddle assembly is moved by an upper body movement of the user.

In another embodiment, an aquatic exercising assembly is provided. The aquatic exercising assembly includes a container having a liquid retention portion and a plurality of ascending stairs. The liquid retention portion includes a bottom wall, a pair of opposing sidewalls, and a pair of opposing end walls, a pair of descending steps, a pedal assembly and a paddle assembly. The pair of descending steps are formed from one of the pair of opposing end walls. The pedal assembly is rotatably coupled to the one of the pair of opposing end walls. The paddle assembly is coupled to each one of the pair of opposing sidewalls. The paddle assembly is movable between a rearward position and a forward position in a longitudinal direction. The pedal assembly is rotatably moved by a lower body movement of a user and the paddle assembly is moved by an upper body movement of the user.

In yet another embodiment, a method for using the aquatic exercising assembly is provided. The method includes entering, via a plurality of ascending stairs and a pair of descending step, a liquid retention portion of a container, sitting onto a lower step of the pair of descending steps, and positioning a pair of feet onto a pedal assembly. The method continues by gripping a handle portion of a paddle assembly, rotating the pedal assembly via the pair of feet, and moving the paddle assembly between a rearward position and a forward position in a longitudinal direction.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are generally directed to an aquatic exercise equipment assembly. The aquatic exercise equipment assembly is a container in a closed system with a liquid retention portion to hold a liquid, such as water, and a user. As such, the user receives the benefits of non-weight bearing health benefit through buoyancy of the liquid, such as water. The liquid retention portion includes a sitting portion for the user to position thereon. Further, within the liquid retention portion is a paddle assembly for an upper body movement and a pedal assembly for a lower body movement. The paddle assembly is a pair of independently movable paddles that are rotatable between a forward and rearward position. The pedal assembly includes a pair of pedals that are rotatable movable. It should be appreciated that the resistance of paddle assembly and the pedal assembly is caused from the resistance of the liquid, such as water, within the liquid retention portion. Moreover, it should be understood that the paddle assembly and the pedal assembly assist users through controlled ranges of motion or specific movements that are desirable for each user.

Further, the aquatic exercise equipment assembly includes a filtration system that allows for the continuous use of treated liquids, such as water, between users. In addition, the buoyancy of the liquid may be adjusted for particular users using the filtration system. Further, the liquid temperature may be adjusted to meet specific needs of individual users. For example, warm liquid used in aquatic therapy reduces spasticity and relaxes muscles thereby allowing individuals to move with greater mobility and less pain. As such, users gain the general benefits of exercise without suffering from the compressive and torque forces associated with the gravity of a dryland exercise setting.

As used herein, the term "communicatively coupled" means that coupled components are capable of exchanging data signals and/or electric signals with one another such as, for example, electrical signals via conductive medium, electromagnetic signals via air, optical signals via optical waveguides electrical energy via conductive medium or a non-conductive medium, data signals wirelessly and/or via conductive medium or a non-conductive medium and the like.

Figure 1:
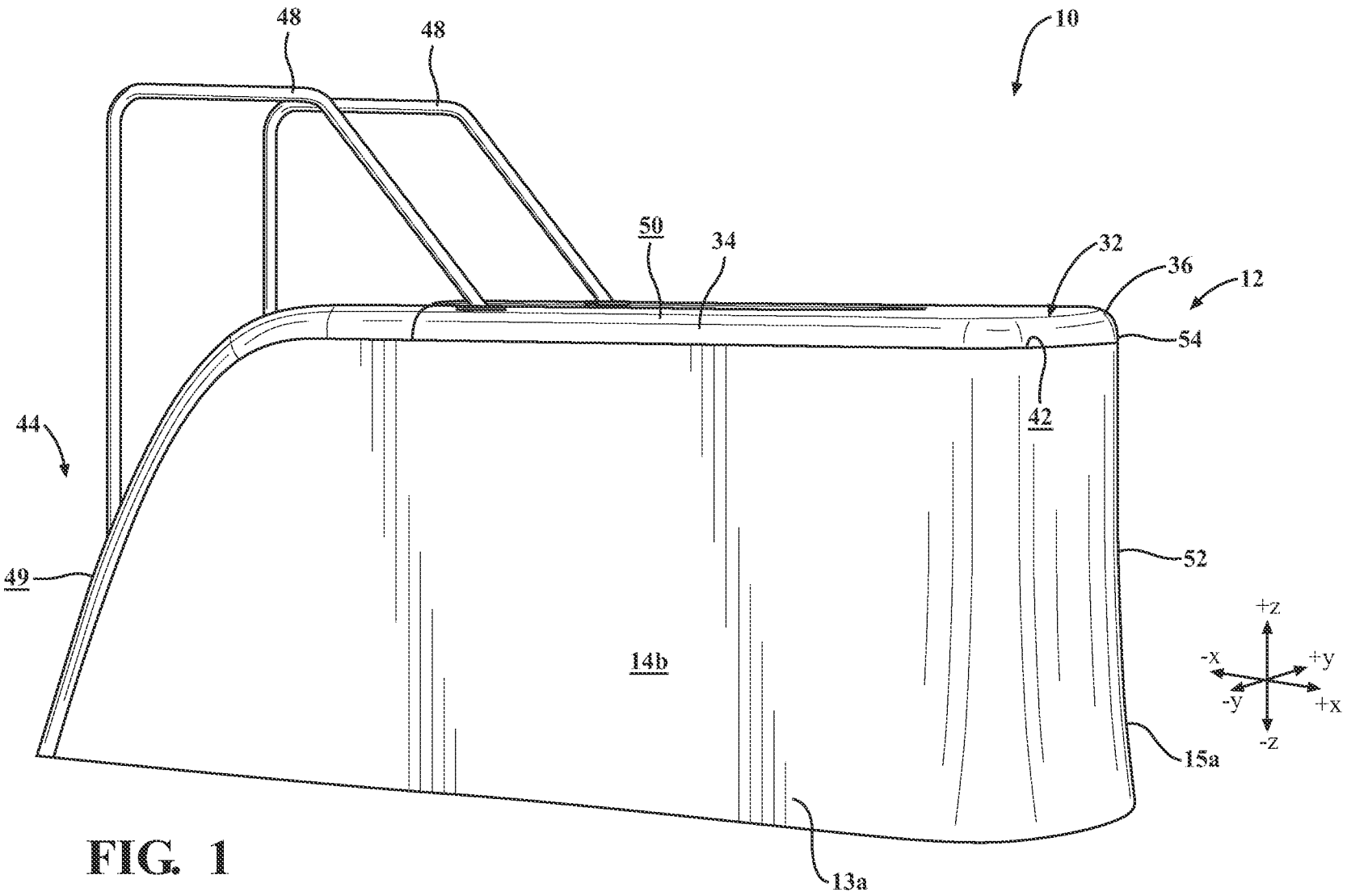
FIG. 1 schematically depicts a perspective view of the aquatic exercise equipment assembly according to one or more embodiments shown and described herein.
Figure 2:
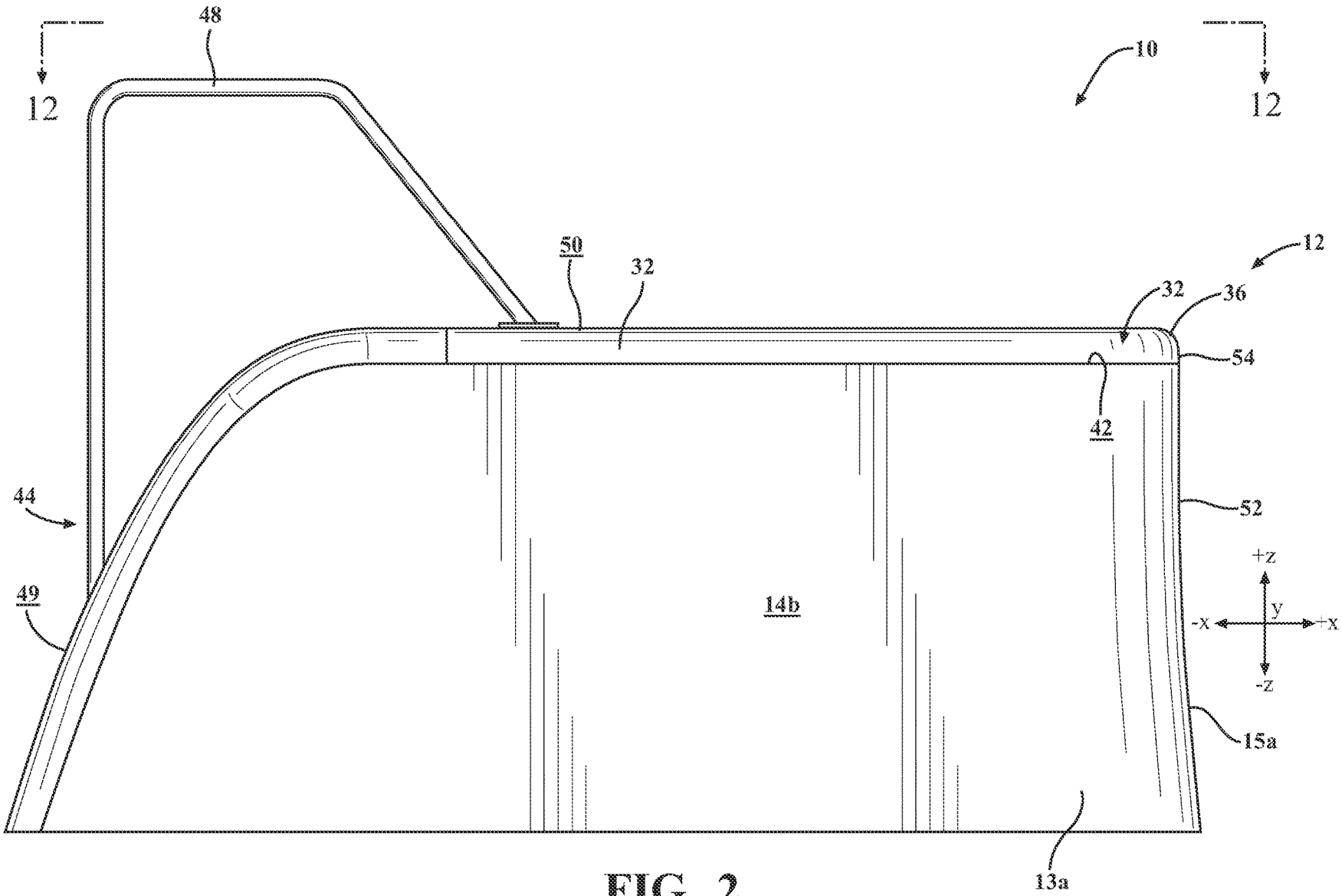
FIG. 2 schematically depicts a side view of the aquatic exercise equipment assembly of FIG. 1 according to one or more embodiments shown and described herein.
Figure 4:
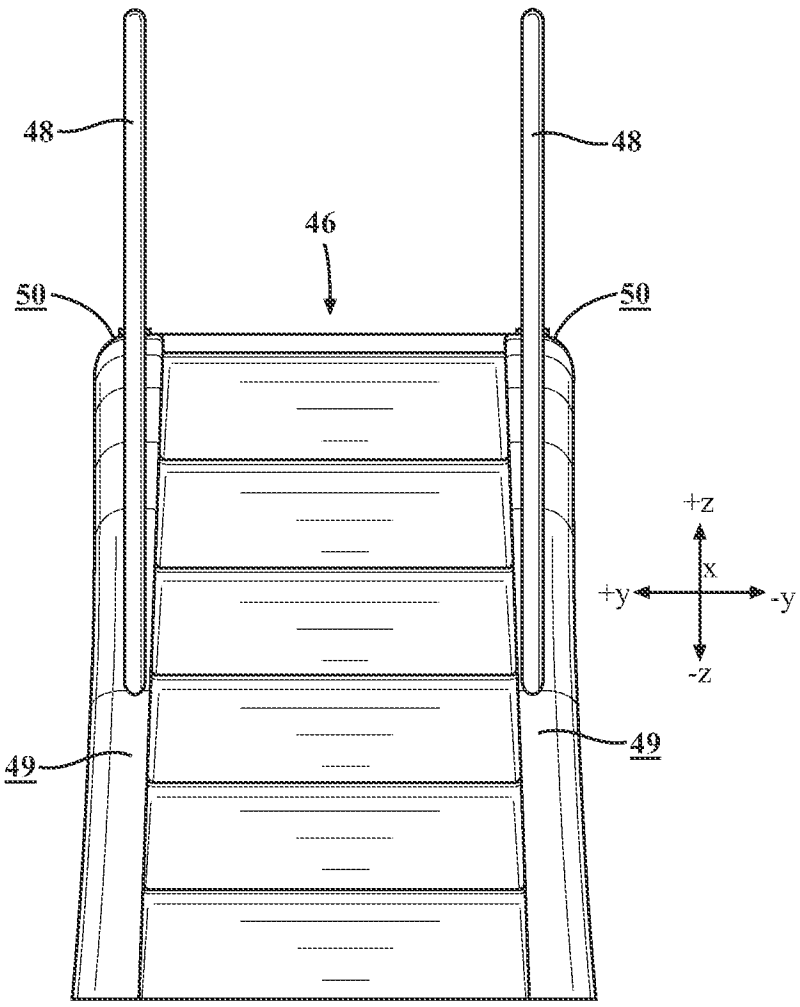
FIG. 4 schematically depicts a rear view of the aquatic exercise equipment assembly of FIG. 1 according to one or more embodiments shown and described herein.
Figure 3:
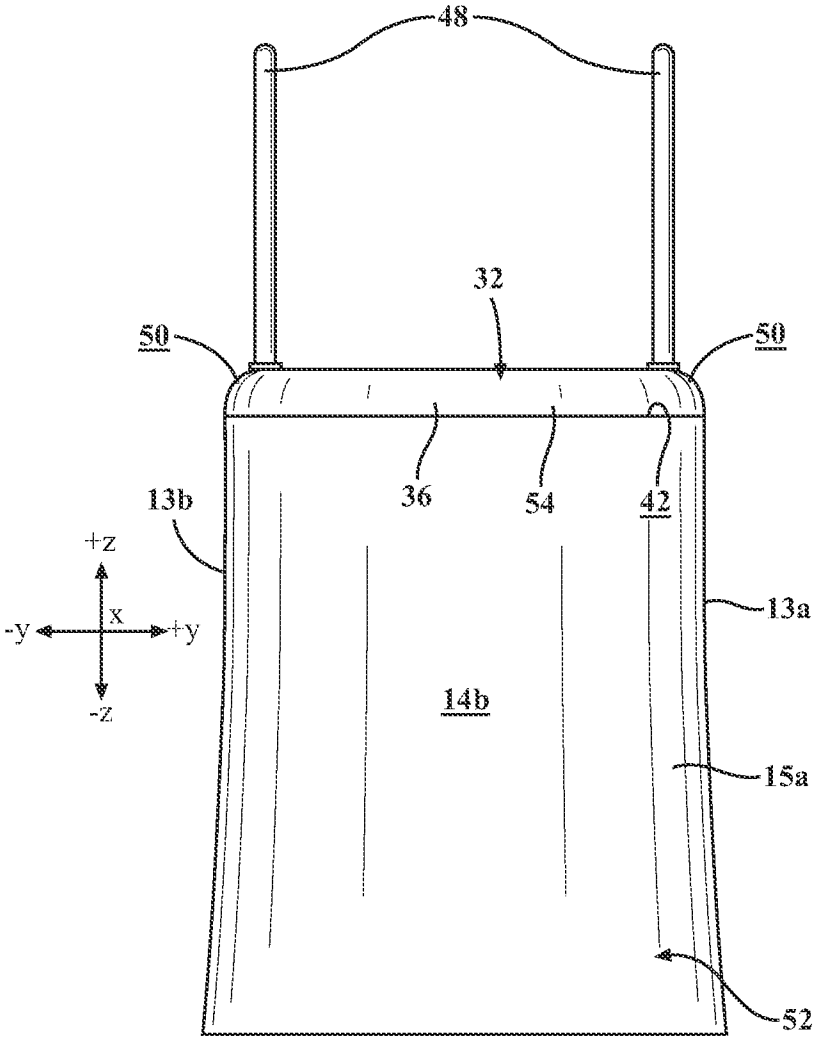
FIG. 3 schematically depicts a front view of the aquatic exercise equipment assembly of FIG. 1 according to one or more embodiments shown and described herein.

As used herein, the term "longitudinal direction" refers to the forward-rearward direction of the aquatic exercise equipment assembly (i.e., in the +/−X-direction depicted in FIG. 1). The term "lateral direction" refers to the cross direction of the aquatic exercise equipment assembly (i.e., in the +/−Y-direction depicted in FIG. 1), and is transverse to the longitudinal direction. The term "vertical direction" or "below" or "above" refer to the upward-downward direction of the aquatic exercise equipment assembly (i.e., in t he +/−Z-direction depicted in FIG. 1).

Referring now to FIGS. 1-7 and 11-13, an aquatic exercise equipment assembly 10 is schematically depicted. The aquatic exercise equipment assembly 10 includes a container 12. The container 12 includes a pair of spaced apart sidewalls 13*a*, 13*b*, a pair of spaced apart end walls 15*a*, 15*b*, and a bottom wall 17. In some embodiments, each of the pair of spaced apart sidewalls 13*a*, 13*b*, the pair of spaced apart end walls 15*a*, 15*b*, and the bottom wall 17 include an inner surface 14*a* and an opposite outer surface 14*b* to create a liquid retention portion 16. That is, the container 12 is configured to retain a liquid, such as water, within the pair of sidewalls 13*a*, 13*b*, the pair of end walls 15*a*, 15*b*, and the bottom wall 17 of the liquid retention portion 16. As such, the liquid retention portion 16 may be a water tank, a tub, a pool, and/or the like.

In other embodiments, each of the pair of spaced apart sidewalls 13*a*, 13*b*, the pair of spaced apart end walls 15*a*, 15*b*, and the bottom wall 17 include the inner surface 14*a*, which is spaced apart from the outer surface 14*b* to create a liquid retention portion 16.

Within the liquid retention portion 16, a pair of descending steps 18 form a portion of the end wall 15*b*. The pair of descending steps 18 includes a lower step 21 and an upper step 23 relative to the bottom wall 17 in the vertical direction (i.e., in the +/−Z direction). The lower step 21 of the pair of descending steps 18 includes an upper surface 19 that is also a seat portion 20. The seat portion 20 includes a pair of arcuate cutouts 22 to provide additional room for each leg 24 of a user 26 to move, as discussed in greater detail herein. The upper step 23 of the pair of descending steps 18 includes an upper surface 27 and an arcuate cutout portion 28 that receives a portion of a back 30 of the user 26 when the user 26 is seated on the seat portion 20. In some embodiments, each or both of the pair of descending steps 18 includes a textured surface to assist the user 26 in entering and exiting the liquid retention portion 16. Further, as discussed in greater detail herein, the liquid retention portion 16 further includes a paddle assembly 38 and a pedal assembly 40. In some embodiments, the pedal assembly 40 may include a pedal assembly cover 71, a pedal receiving portions 68, a pair of pedal arms 76*a*, 76*b* and a pair of pedals 74 (all depicted in FIG. 5), as discussed in greater detail herein Still referring to FIGS. 1-7 and 11-13, in some embodiments, the shape of the pair of sidewalls 13*a*, 13*b* and the pair of end walls 15*a*, 15*b* form an elongated, rectangular shaped liquid retention portion 16. In other embodiments, the liquid retention portion 16 of the container 12 may be any shape such as a square, oval, elliptical, circular, hexagonal, and the like. As such, the liquid retention portion 16 of the container 12 may be any regular shape. In other embodiments, the liquid retention portion 16 of the container 12 may be an irregular shape. Further, each of the pair of sidewalls 13*a*, 13*b* and the pair of end walls 15*a*, 15*b* include an upper surface 42.

In some embodiments, portions of the liquid retention portion 16 may be partially or wholly enclosed by a cover 32. In some embodiments, the cover 32 may be U-shaped with a pair of legs 34 and a base portion 36. In other embodiments, the cover 32 may only include the base portion 36. The cover 32 may be a separate component that is positioned along the upper surface 42 of the pair of sidewalls 13*a*, 13*b* and the pair of end walls 15*a*, 15*b*. The cover 32 may be formed with a receiving groove or other receiving portions that receive the upper surface 42 of the pair of sidewalls 13*a*, 13*b* and the pair of end walls 15*a*, 15*b*. Alternatively, the cover 32 may be coupled or attached to the upper surface 42 of the pair of sidewalls 13*a*, 13*b* and the pair of end walls 15*a*, 15*b* via a fastener such as a bolt and nut, a screw, a hook and loop, an epoxy, an adhesive, and the like.

In other embodiments, the cover 32 may be integrally formed with the upper surface 42 of the pair of sidewalls 13*a*, 13*b* and the pair of end walls 15*a*, 15*b* of the liquid retention portion 16. That is, in some embodiments, the cover 32 may be a monolithic structure formed with the upper surface 42 of the pair of sidewalls 13*a*, 13*b* and the pair of end walls 15*a*, 15*b* of the liquid retention portion 16.

Still referring to FIGS. 1-7 and 11-13, a rear portion 44 of the aquatic exercise equipment assembly 10 further includes a plurality of ascending stairs 46. The plurality of ascending stairs 46 permit the user 26 access to, or exit from, the liquid retention portion 16 of the container 12. In some embodiments, the plurality of ascending stairs 46 are textured to provide a grip to the user 26 when ascending and/or descending the plurality of ascending stairs 46. Further, a pair of handrails 48 are positioned on either side of the plurality of ascending stairs 46 extending from an outer surface 49 of the container 12 to an exterior surface 50 of the cover 32. That is, each of the pair of handrails 48 extend from the outer surface 49 of the container 12 to the exterior surface 50 of the pair of legs 34 to assist the user 26 in ascending and/or descending the plurality of ascending stairs 46. Each of the pair of handrails 48 may be made of metal. For example, each of the pair of handrails 48 may be steel, aluminum, aluminum alloy, and the like.

A front end 52 of the container 12 may be arcuate with a convex shape contour 53 extending from the end wall 15*a* of the liquid retention portion 16. The base portion 36 of the cover 32 may also include a convex portion 54 that matches the convex shape contour 53 of the front end 52 of the container 12. Moreover, a bottom surface 56 of the container 12 extends a length of the of the aquatic exercise equipment assembly 10 and includes a convex shape at a nose portion 58 and an indention 60 at a rear portion 62. As such, the bottom surface 56 of the container 12 extends beneath the plurality of ascending stairs 46, the liquid retention portion 16, and the front end 52 in the system vertical direction (i.e., in the +/−Z direction) such that the plurality of ascending stairs 46 are positioned at the indention 60.

In some embodiments, the plurality of ascending stairs 46 and the liquid retention portion 16 are a monolithic structure. As such, in some embodiments, the plurality of ascending stairs 46 and the liquid retention portion 16 are each made of a resin material. In other embodiments, the plurality of ascending stairs 46 and the liquid retention portion 16 are each made of a polymer, concrete, fiberglass, epoxy resin, combinations thereof, and/or the like.

In other embodiments, the plurality of ascending stairs 46 and the liquid retention portion 16 are separate components that are coupled together via a fastener such as nut and bolts, screws, hook and loop, epoxies, adhesives, and/or the like. In this embodiment, the plurality of ascending stairs 46 and the liquid retention portion 16 may be a same material or different materials. For example, the plurality of ascending stairs 46 may be a polymer and the liquid retention portion 16 is a resin. This is non-limiting and both the plurality of ascending stairs 46 and the liquid retention portion 16 may each be a polymer, concrete, resin, fiberglass, epoxy resin, combinations thereof, and/or the like.

Figure 11:
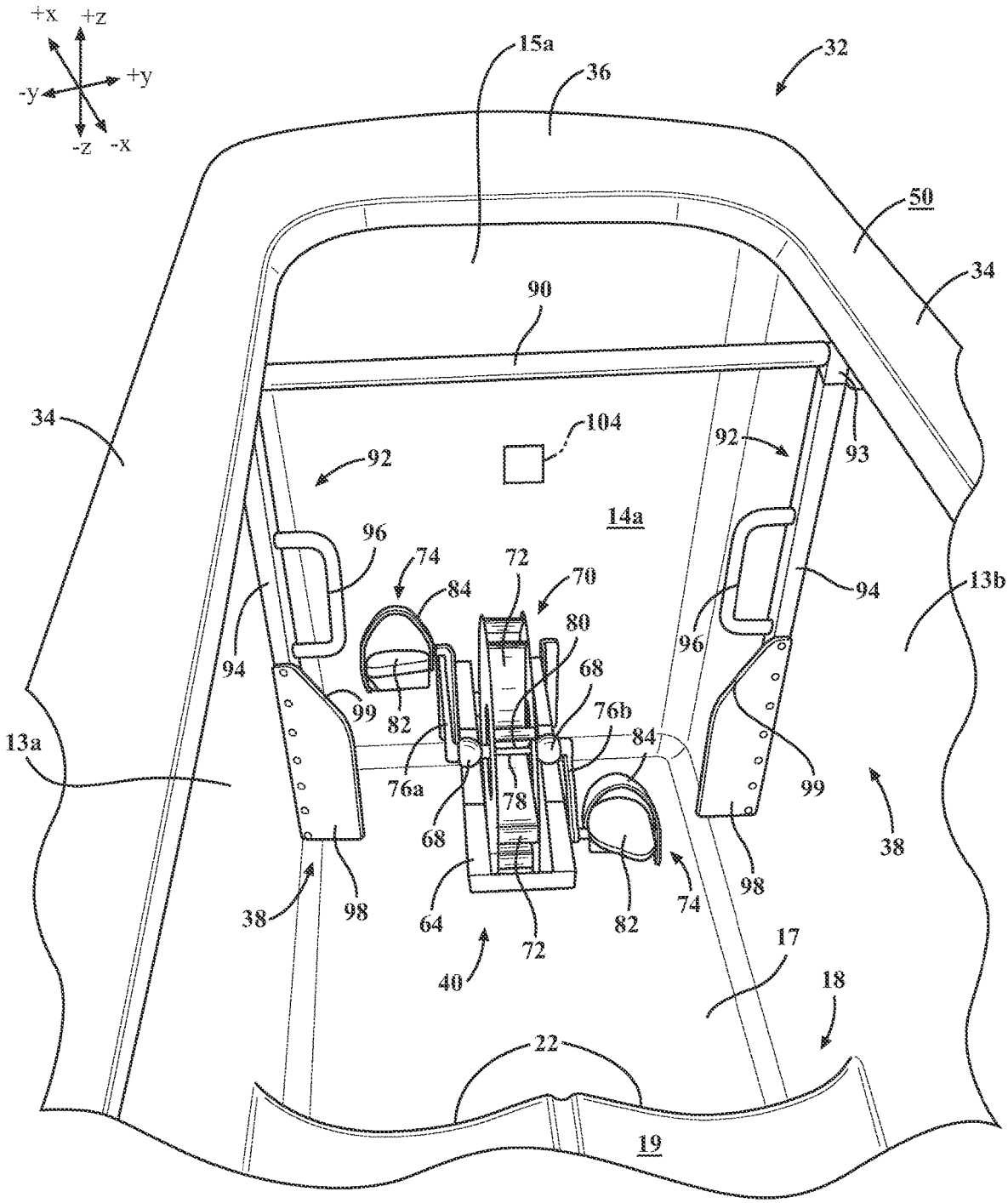
FIG. 11 schematically depicts an isolated view of a rudder assembly and a pedal assembly of the aquatic exercise equipment assembly of FIG. 1 in a neutral positon according to one or more embodiments shown and described herein.
Figure 12:
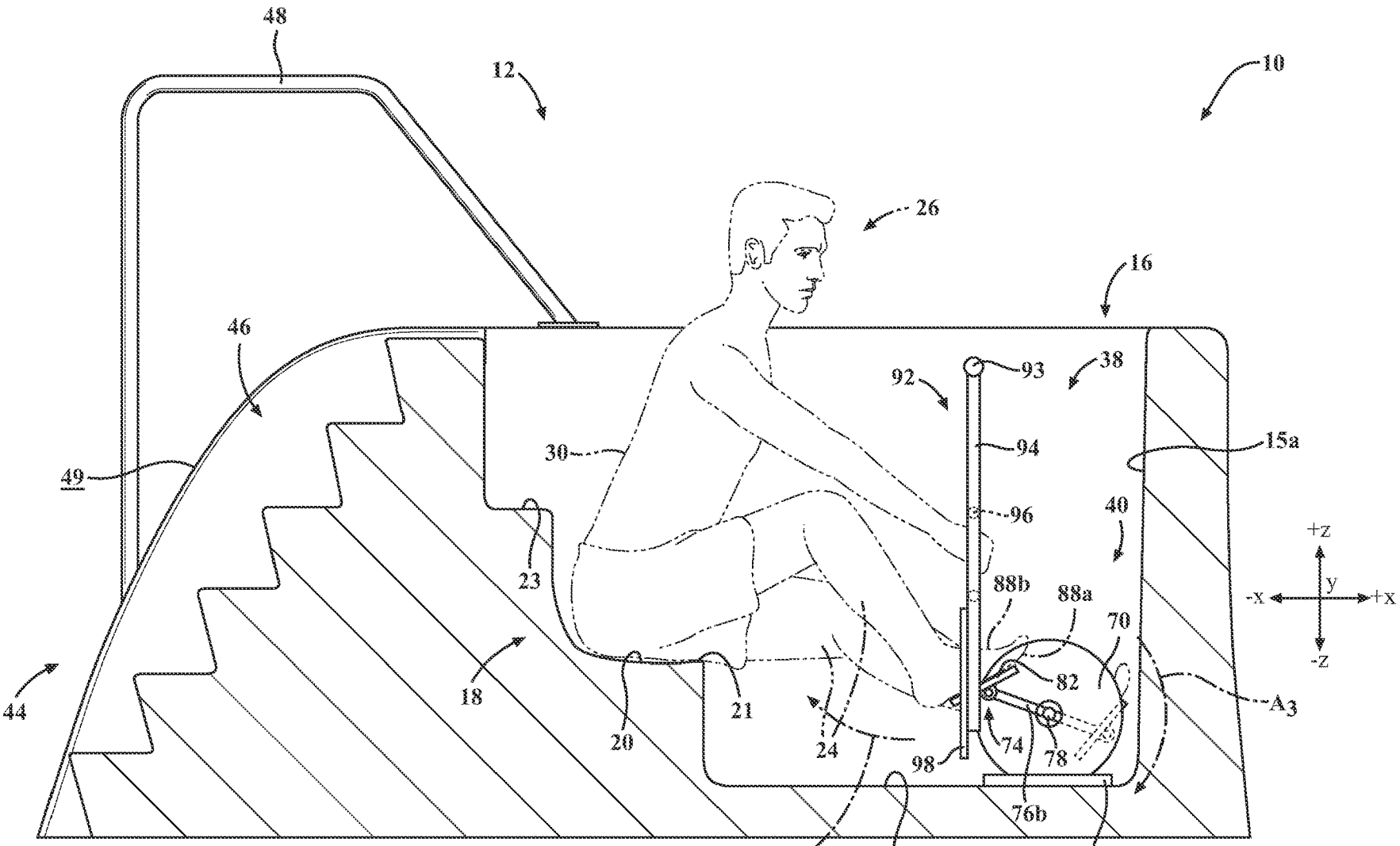
FIG. 12 schematically depicts a cross sectional view of FIG. 2 taken from line 12-12 illustrating the paddle assembly of the aquatic exercise equipment assembly of FIG. 11 in a forward position according to one or more embodiments shown and described herein.
Figure 13:
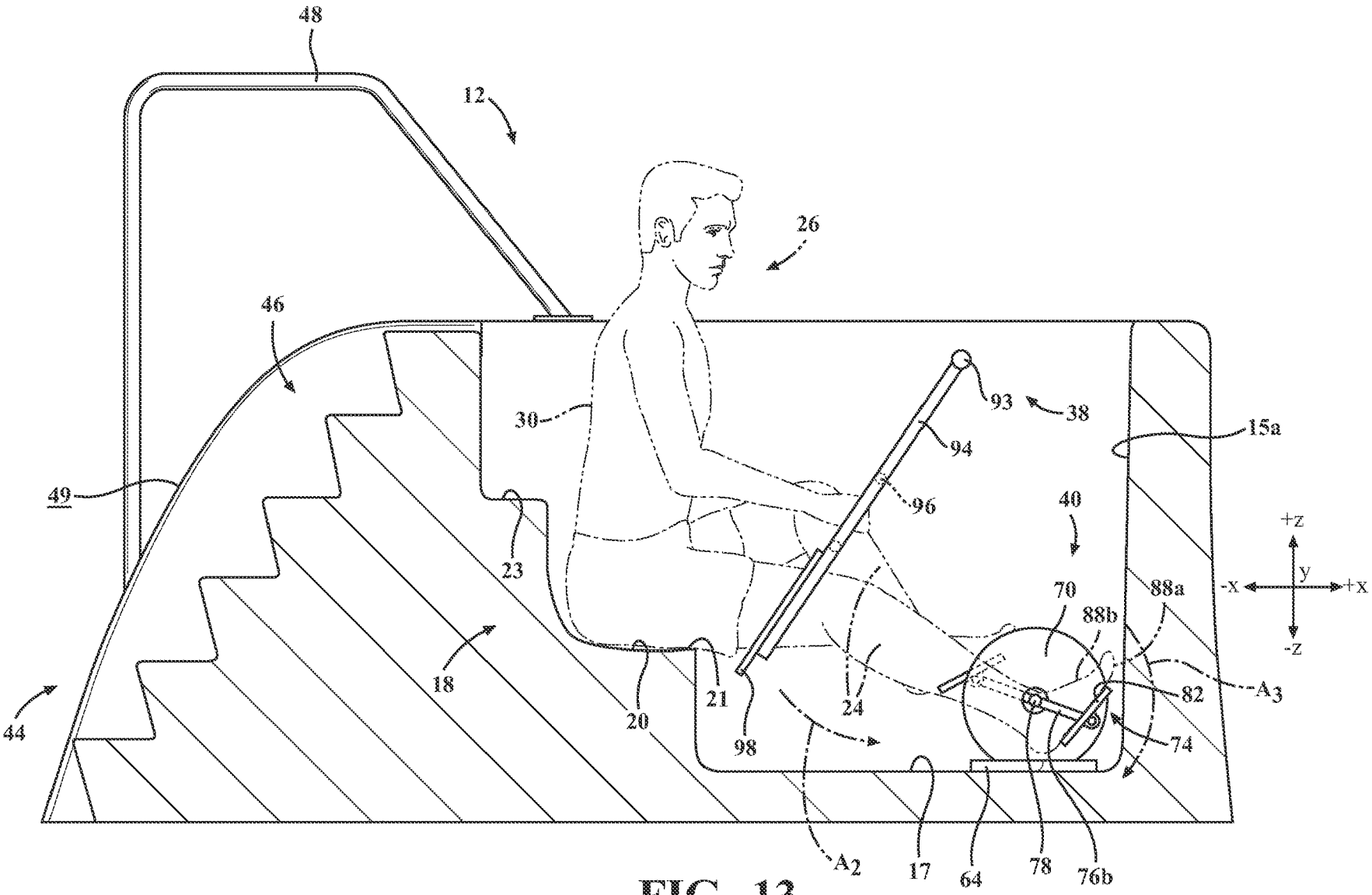
FIG. 13 schematically depicts a cross sectional view of FIG. 2 taken from line 12-12 illustrating the paddle assembly of the aquatic exercise equipment assembly of FIG. 11 in a rearward position according to one or more embodiments shown and described herein.

Now referring to FIGS. 11-13, the pedal assembly 40 includes a frame 64. In some embodiments, the frame 64 is mounted or coupled to the bottom wall 17 of the liquid retention portion 16. In this embodiment, the frame 64 is mounted or coupled to the bottom wall 17 of the liquid retention portion 16 via a fastener, such as a screw, nut and bolt, epoxy, and/or the like. In other embodiments, the frame 64 is mounted or coupled to the end wall 15*a* of the liquid retention portion 16. In this embodiment, the frame 64 is mounted or coupled to the end wall 15*a* of the liquid retention portion 16 via a fastener, such as a screw, nut and bolt, epoxy, and/or the like. In other embodiments, the frame 64 is mounted or coupled to the bottom wall 17 and the end wall 15*a* of the liquid retention portion 16. In this embodiment, the frame 64 is mounted or coupled to the bottom wall 17 and the end wall 15*a* of the liquid retention portion 16 via a fastener, such as a screw, nut and bolt, epoxy, and/or the like.

In some embodiments, the frame 64 is mounted or coupled to the bottom wall 17 and/or the end wall 15*a* to be positioned above the bottom wall 17 in the vertical direction (i.e., in the +/−Z direction). Further, the frame 64 includes an opening 66. In some embodiments, the frame may be a metal. For example, the frame 64 may be a steel, iron, aluminum, aluminum alloy, and/or the like. As such, the frame 64 may be constructed with angle iron, unistrut, and/or the like. In other embodiments, the frame 64 may be a polymer, a resin, a fiberglass, and/or the like. The frame 64 includes a pedal receiving portions 68, as discussed in greater detail herein.

A flywheel 70 is rotatable coupled to the frame 64. The flywheel 70 is positioned to rotate with respect to the frame 64 and a portion of the flywheel 70 may move through the opening 66 of the frame 64. The flywheel 70 includes a plurality of liquid receiving depressions 72 or cups that is configured to create a resistance when the flywheel 70 is rotated or moved through the liquid retained or held within the liquid retention portion 16, as discussed in greater detail herein. Further, in some embodiments, the entire flywheel 70 is submersed below a liquid level. In other embodiments, a portion of the flywheel 70 is positioned above a liquid level such that portions of the flywheel 70 is submerged within the liquid while other portions are not submerged or position above a liquid level. As such, the flywheel 70 may act or be a turbine that uses the liquid within the liquid retention portion 16.

In some embodiments, the flywheel 70 may be constructed with a metal material. For example, the flywheel 70 may be a steel, iron, aluminum, aluminum alloy, and/or the like. As such, the flywheel 70 may be constructed with angle iron, unistrut, and/or the like. In other embodiments, the flywheel 70 may be a polymer, a resin, a fiberglass, and/or the like.

Figure 5:
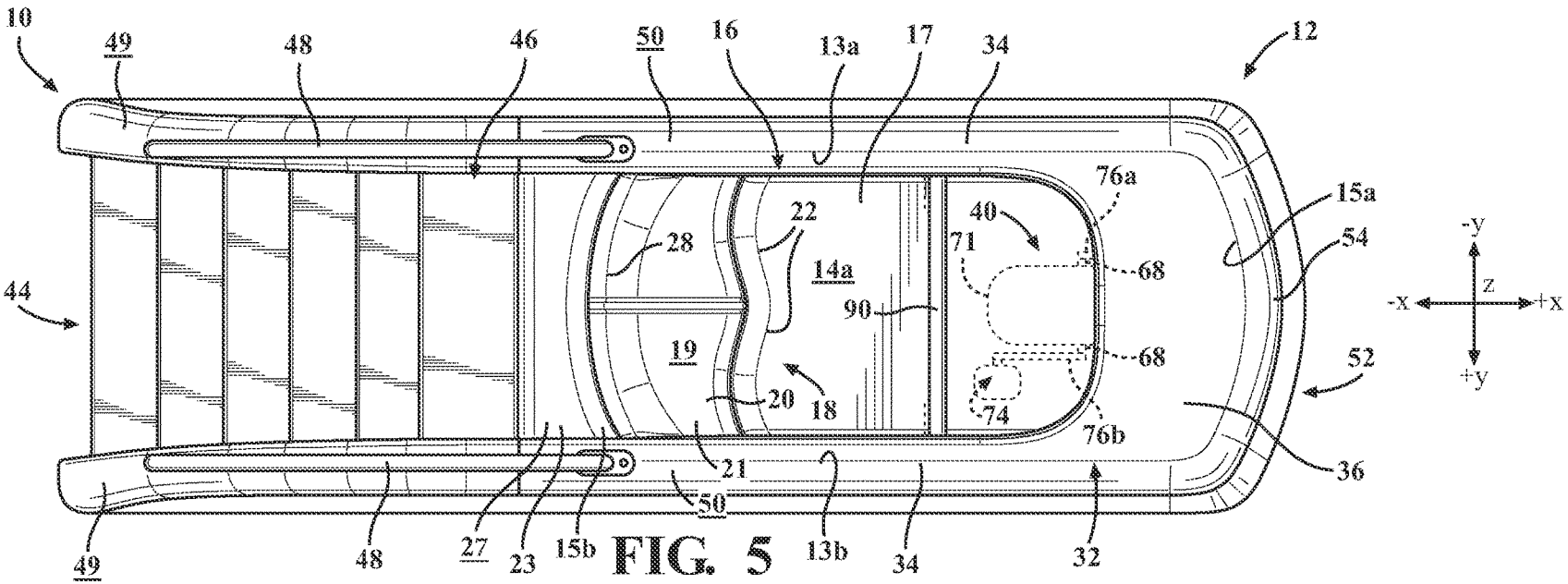
FIG. 5 schematically depicts a top view of the aquatic exercise equipment assembly of FIG. 1 according to one or more embodiments shown and described herein.
Figure 6:
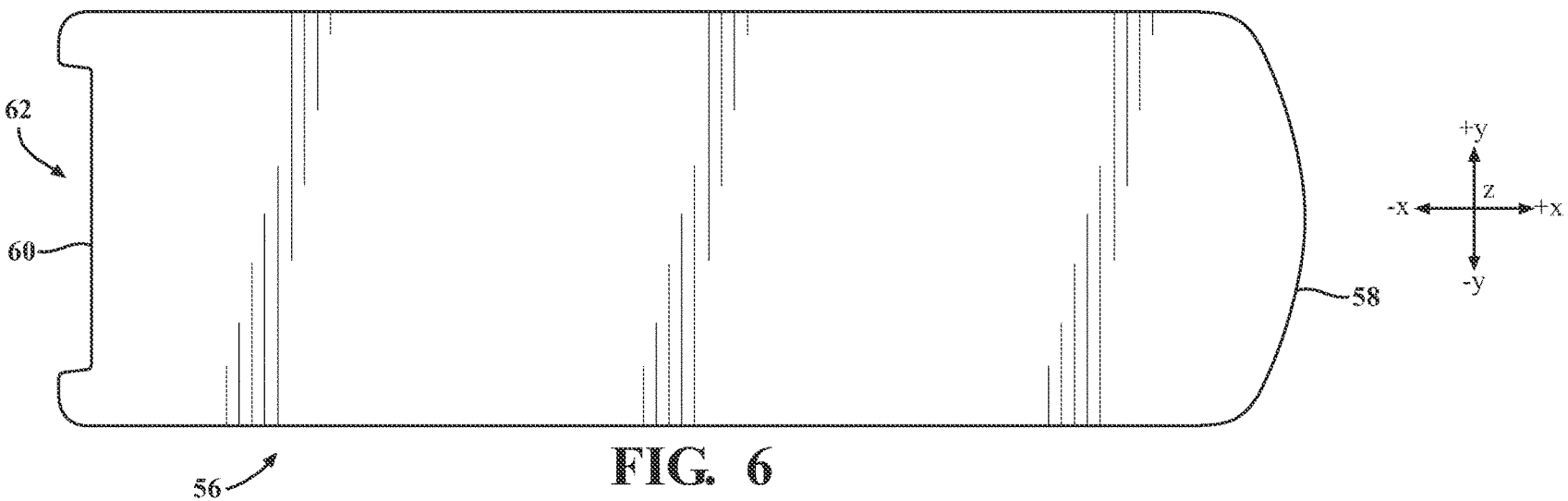
FIG. 6 schematically depicts a bottom view of the aquatic exercise equipment assembly of FIG. 1 according to one or more embodiments shown and described herein.
Figure 7:
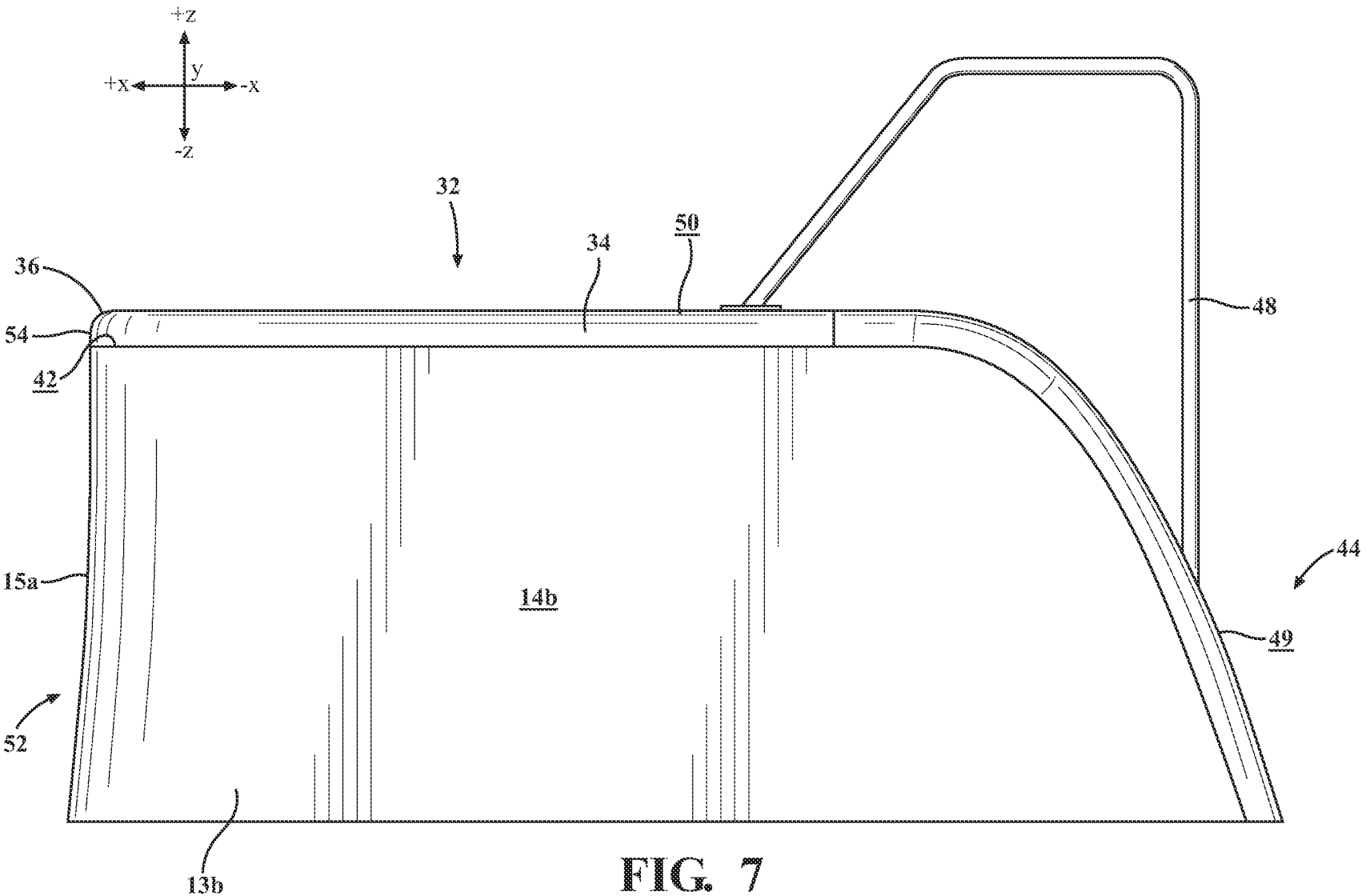
FIG. 7 schematically depicts a side view of the aquatic exercise equipment assembly of FIG. 1 according to one or more embodiments shown and described herein.

Still referring to FIGS. 11-13 and now also to FIG. 5, the flywheel 70 may be partially enclosed by a pedal assembly cover 71 (FIG. 5). The pedal assembly cover 71 may extend from the end wall 15*a* to partially cover the flywheel 70. In some embodiments, the pedal assembly cover 71 is a monolithic structure formed with the end wall 15*a* and extending from the end wall 15*a* in the longitudinal direction (i.e., in the +/−X direction). In other embodiments, the pedal assembly cover 71 is a separate component that is attached or coupled to the end wall 15*a* to extend in the longitudinal direction (i.e., in the +/−X direction). In this embodiment, the pedal assembly cover 71 is attached or coupled to the end wall 15*a* via a fastener, such as a nut and bolt, screw, rivets, epoxy, weld, adhesive, and/or the like.

Referring back to FIGS. 11-13, the pair of pedals 74 are rotatable coupled to the pair of pedal arms 76*a*, 76*b*. The pedal arms 76*a*, 76*b* are coupled to a drive shaft 78 that extends in the lateral direction (i.e., in the +/−Y direction) to connect to each of the pedal arms 76*a*, 76*b* and the flywheel 70. That is, in some embodiments, the drive shaft 78 is coupled to a drive shaft receiving portion 80 of the flywheel 70 and to each of the pedal arms 76*a*, 76*b*. In some embodiments, the drive shaft 78 is coupled to the drive shaft receiving portion 80 of the flywheel 70 via welding, adhesive, epoxy, a fastener, such as a screw, rivet, bolt and nut, and/or the like. As such, the drive shaft 78 and the flywheel 70 may rotate freely. The drive shaft 78 is rotatably positioned within the pedal receiving portions 68 and is coupled to the each of pair of pedal arms 76*a*, 76*b* via a fastener such as a screw, a bolt and nut, a hook and loop, and/or the like.

In some embodiments, the pedal arms 76*a*, 76*b* and the drive shaft 78 may be constructed with a metal. For example, the pedal arms 76*a*, 76*b* and the drive shaft 78 may, individually or together, be a steel, iron, aluminum, aluminum alloy, and/or the like. In other embodiments, the pedal arms 76*a*, 76*b* and the drive shaft 78, individually or together, may be a polymer, a resin, a fiberglass, and/or the like.

Still referring to FIGS. 11-13, each of the pair of pedals 74 include a footrest portion 82 and a foot retention portion 84. The footrest portion 82 may be a planer surface that receives a bottom surface 88*a* of a foot 86 of the user 26. The foot retention portion 84 is coupled to each side of the footrest portion 82 to retain an upper surface 88*b* of the foot 86. That is, the foot retention portion 84 assists in retaining the bottom surface 88*a* of the foot 86 of the user 26 against the footrest portion 82. The foot retention portion 84 may be adjustable between the various users 26.

In some embodiments, the pair of pedals 74 may each be constructed with a metal such as a steel, an aluminum, an aluminum allow, and/or the like. In other embodiments, the pair of pedals 74 may each be constructed with a polymer, resin, fiberglass, and/or the like. Further, in some embodiments, the foot retention portion 84 may be constructed with a flexible, resilient material, such as a polymer, fabric, nylon, plastic, and/or the like.

Still referring to FIGS. 11-13, the paddle assembly 38 includes a cross member 90, a pair of movable paddles 92 that are movable between a forward and rearward position in the longitudinal direction (i.e., in the +/−X direction), and a pair of receiving portions 93. Each of the receiving portions 93 include portions to receive both the cross member 90 and one of the pair of movable paddles 92. In some embodiments, each of the receiving portions 93 are a monolithic structure formed with the pair of sidewalls 13*a*, 13*b*. In other embodiments, each of the receiving portions 93 are attached or coupled to one of the pair of sidewalls 13*a*, 13*b*, respectively. Each of the receiving portions 93 are also positioned below the cover 32 in the vertical direction (i.e., in the +/−Z direction).

Further, in some embodiments, each of the receiving portions 93 may be coupled or attached to the pair of sidewalls 13*a*, 13*b* via fasteners, such as a bolt and nut, rivet, screw, epoxy, adhesive, and the like. In some embodiments, each of the receiving portions 93 are submersed below the liquid level. In other embodiments, portions of each of the receiving portions 93 are above the liquid level. In some embodiments, each of the receiving portions 93 may be constructed with a metal material. For example, the each of the receiving portions 93 may be a steel, iron, aluminum, aluminum alloy, and/or the like. In other embodiments, the each of the receiving portions 93 may be a polymer, a resin, a fiberglass, and/or the like.

The cross member 90 extends between the pair of sidewalls 13*a*, 13*b* and is coupled to each of the receiving portions 93. As such, the cross member 90 extends along a plane and is positioned below the cover 32 in the vertical direction (i.e., in the +/−Z direction). In some embodiments, the cross member 90 is positioned to submerged below the liquid level. In other embodiments, the cross member 90 is positioned to be at least partially above the liquid level. Further, in some embodiments, the cross member 90 may be coupled or attached to each of the receiving portions 93 via fasteners, such as a bolt and nut, rivet, screw, epoxy, adhesive, and the like. As such, the cross member 90 is stationary and may be used to assist the user 26 in sitting and/or standing in the liquid retention portion 16.

In some embodiments, the cross member 90 is a round stock with a circular cross section. In other embodiments, the cross member 90 may be other shapes, such as square, hexagonal, octagonal, and/or the like. In some embodiments, the cross member 90 may be constructed with a metal material. For example, the cross member 90 may be a steel, iron, aluminum, aluminum alloy, and/or the like. As such, the cross member 90 may be constructed with angle iron, unistrut, round stock, and/or the like. In other embodiments, the cross member 90 may be a polymer, a resin, a fiberglass, and/or the like.

Still referring to FIGS. 11-13, the pair of movable paddles 92 are each positioned adjacent to opposite sidewalls 13*a*, 13*b* and are each coupled or attached to one of the receiving portions 93 respectively. Each of the pair of movable paddles 92 include an elongated member 94, a handle portion 96, and rudder portion 98. The elongated member 94 of each of the pair of movable paddles 92 extends generally in the vertical direction (i.e., in the +/−Z direction). The handle portion 96 is positioned above the rudder portion 98 in the vertical direction (i.e., in the +/−Z direction).

In some embodiments, both the handle portion 96 and the rudder portion 98 are coupled or attached to the elongated member 94 via fasteners such as bolts and nuts, rivets, screws, welded, epoxy, adhesive, and/or the like. In other embodiments, the handle portion 96 is formed as a monolithic structure with the elongated member 94. In some embodiments, the handle portion 96 is generally a U-shape that, along with the elongated member 94, form an enclosed handle portion that allows for multiple grip positions for the user 26. As such, in some embodiments, portions of the elongated member 94 and/or the handle portion 96 may be textured to provide additional grip to the user 26. The handle portion 96 is submersed within the liquid of the liquid retention portion 16.

In some embodiments, the elongated member 94 and/or the handle portion 96 is a round stock with a circular cross section. In other embodiments, the elongated member 94 and/or the handle portion 96 may be other shapes, such as square, hexagonal, octagonal, and/or the like. In some embodiments, the elongated member 94 and/or the handle portion 96 may each be constructed with a metal material. For example, the elongated member 94 and/or the handle portion 96 may be a steel, iron, aluminum, aluminum alloy, and/or the like. In other embodiments, the elongated member 94 and/or the handle portion 96 may be a polymer, a resin, a fiberglass, and/or the like. Further, in other embodiments, the elongated member 94 and/or the handle portion 96 may be a combination of metal and polymer, resin, fiberglass, and/or the like.

Still referring to FIGS. 11-13, the rudder portion 98 is a flap that extends inwardly in the lateral direction (i.e., in the +/−Y direction) from the elongated member 94 to provide a resistance upon a movement of each of the pair of movable paddles 92. That is, the rudder portion 98 extends away from one of the pair of sidewalls 13*a*, 13*b* towards the other one of the pair of sidewalls 13*a*, 13*b*. In some embodiments, the rudder portion 98 is a linear shaped flap in the vertical direction (i.e., in the +/−Z direction). In other embodiments, the rudder portion 98 is an arcuate shaped flap in the vertical direction (i.e., in the +/−Z direction). That is, the rudder portion 98 may be linear or have an arcuate or curve that changes the resistance of the pair of movable paddles 92 when moved through the liquid, as discussed in greater detail herein.

Further, the rudder portion 98 may be a plurality of different shapes. For example, the rudder portion 98 may be a uniform length or may include at least one angled or tapered portion 99, as best illustrated in FIG. 11. In some embodiments, the entire rudder of the rudder portion 98 is submersed below the liquid level in the liquid retention portion 16. In other embodiments, rudder portion 98 is submersed below the liquid level in the liquid retention portion 16. As such, it should be appreciated that the amount of drag or resistance created by the rudder portion 98 may vary based on the size and shape of the rudder portion 98 as well as the amount of the rudder portion 98 that is in contact with the liquid retained within the liquid retention portion 16.

Each rudder portion 98 is mounted or coupled to the elongated member 94 via a fastener, such as a screw, nut and bolt, epoxy, and/or the like. Further, in some embodiments, the rudder portion 98 may be constructed with a rubber material. In other embodiments, the rudder portion 98 may be constructed of a metal, such as a steel, iron, aluminum, aluminum alloy, and/or the like, or a polymer, a resin, a fiberglass, and/or the like, a flexible, resilient material, such as a fabric, nylon, plastic, and/or the like.

Referring now to FIGS. 12 and 13, the paddle assembly 38 is moved by an upper body movement of the user 26 and the pedal assembly 40 is rotated by a lower body movement of the user 26. As such, the user pulls and/or pushes to move the paddle assembly 38 and pushes onto the pedals to rotate the pedal assembly 40. That is, the pair of movable paddles 92 are movable between a rearward position, as illustrated in FIG. 13 and denoted by the arrow A1 in FIG. 12, and a forward position as illustrated in FIG. 12 and denoted by the arrow A2 in FIG. 13. As such, the pair of movable paddles 92 are movable in the longitudinal direction (i.e., in the +/−X direction). In some embodiments, the pair of movable paddles 92 are movable as a unit or together. In other embodiments, the pair of movable paddles 92 are movable independently of one another. Further, each of the pair of movable paddles 92 may be movable, or pivot, with respect to the receiving portions 93.

The pedal assembly rotates or moves in static position (e.g., rotates or moves with respect to the frame 64, but does not move or rotate along the bottom wall 17). As the user 26 move the pair of pedals 74 in a clockwise direction, the flywheel 70, the drive shaft 78, and the pedal arms 76*a*, 76*b* move or rotate in the clockwise direction as illustrated in FIGS. 12 and 13 and denoted by the arrow A3. It should be appreciated that the user 26 may also pedal in the counter-clockwise direction, which may rotate or move the flywheel 70, the drive shaft 78, and the pedal arms 76*a*, 76*b* in the counter-clockwise direction.

Figure 8:
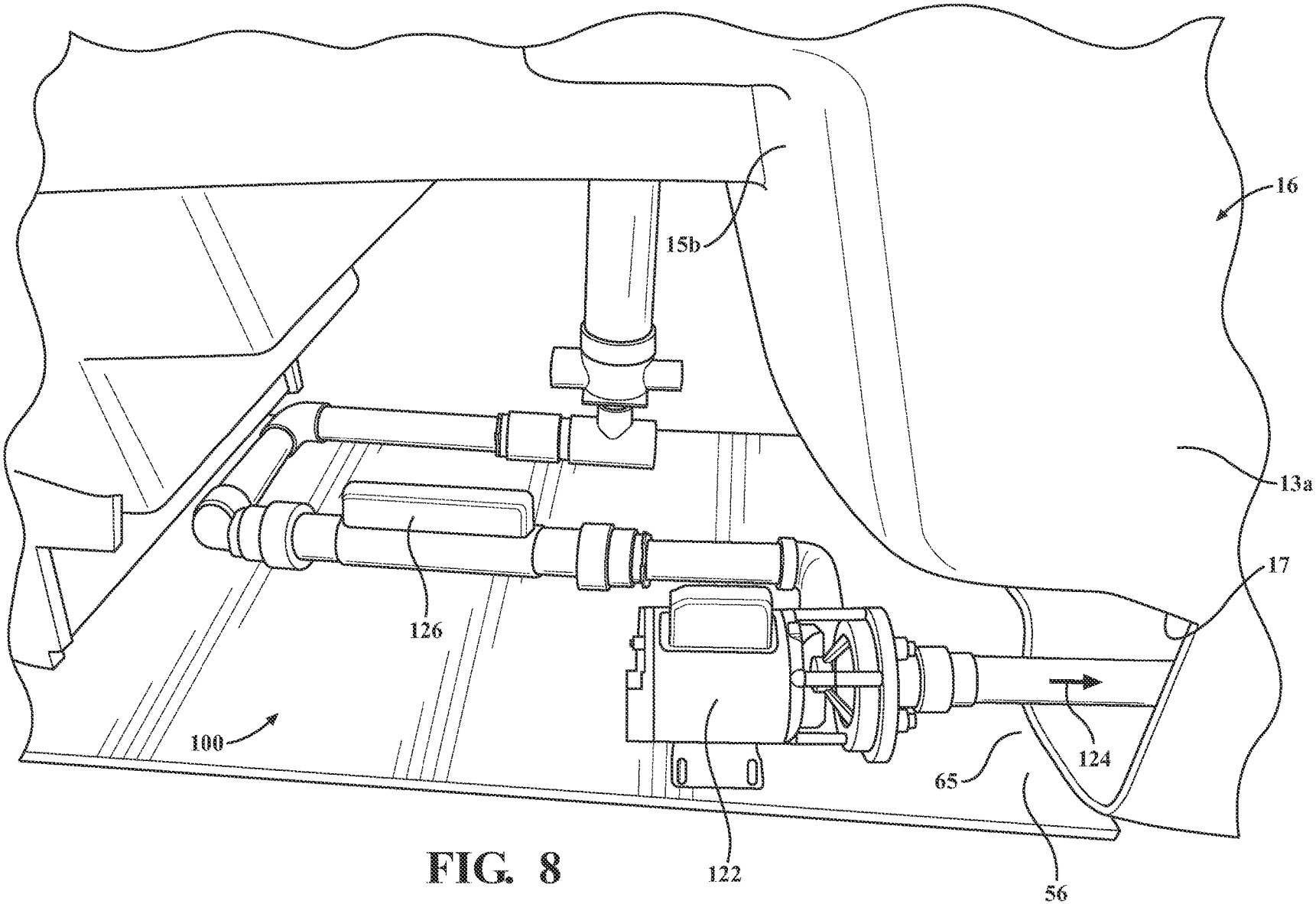
FIG. 8 schematically depicts an isolated view of a liquid filtration system of the aquatic exercise equipment assembly of FIG. 1 according to one or more embodiments shown and described herein.
Figure 9:
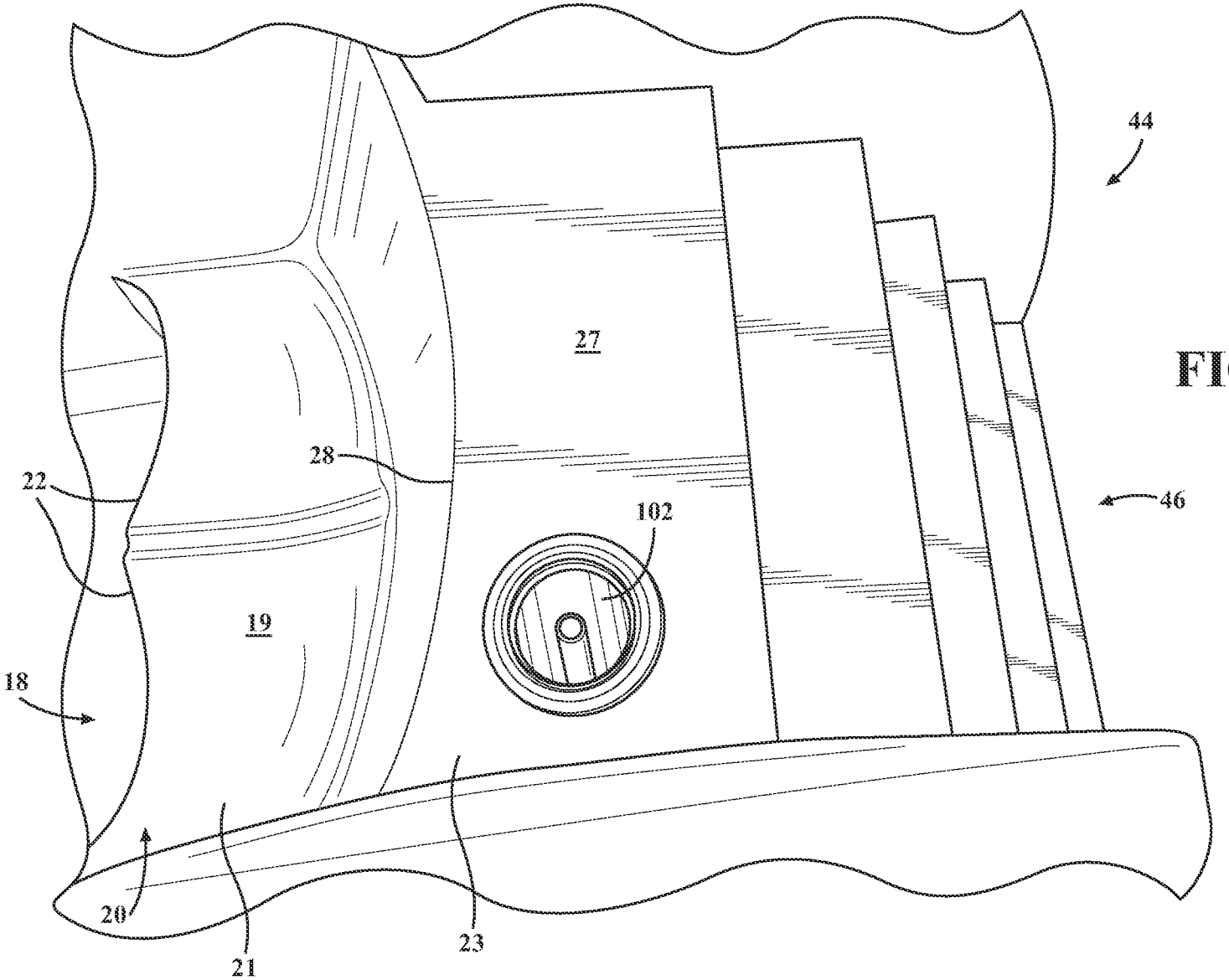
FIG. 9 schematically depicts an isolated view of a filtration system of the aquatic exercise equipment assembly of FIG. 1 according to one or more embodiments shown and described herein.

Now referring to FIGS. 8-9 and 11, a void 65 (FIG. 8) is positioned between the bottom surface 56 and the bottom wall 17 to house a plurality of plumbing 100. A filtration system 102 (FIG. 9) is positioned or embedded within the upper step 23 of the pair of descending steps 18 and may extend through the upper surface 27 of the upper step 23. The filtration system 102 is configured to allow liquid from within the liquid retention portion 16 to drain into and through the plurality of plumbing 100 such that the liquid may be filtered and/or treated before being reintroduced into the liquid retention portion 16. The filtration system 102 may include a cartridge filter, a sand filter, a diatomaceous earth (D.E.) filter, and/or the like. Further, the treatment system may include a chlorine generator, a salt chlorine generator, and/or the like. As such, it should be appreciated that the liquid stored or retained within the liquid retention portion 16 does not need to be changed between users. That is, the liquid of the aquatic exercise equipment assembly 10 (FIG. 1) is filtered and treated for multiple uses with a plurality of users.

The bottom wall 17 and/or the end wall 15*a* may include at least one jet 104 (FIG. 11) that refills the liquid retention portion 16 with filtered and/or treated liquid. Further, the plurality of plumbing 100 may include at least one motor 122 that is configured to force the filtered and/or treated liquid 124 through the at least one jet 104 (FIG. 11) positioned within the liquid retention portion 16. In this embodiment, gravity is used and/or positive pressure from the liquid being forced through the at least one motor 122 or pump to force the water through the filtration system 102. In other embodiments, the at least one motor 122 or pump is configured to suck or vacuum the liquid through the filtration system 102 such that the now filtered and/or treated liquid 124 is forced through the at least one jet 104 positioned within the liquid retention portion 16.

In some embodiments, the plurality of plumbing 100 may further include liquid heating and/or cooling elements 126 that controls the liquid temperature of the liquid retained within the liquid retention portion 16. As such, depicted by arrow 124 in FIG. 8, the liquid that recirculating through the plurality of plumbing 100 has been heated or cooled to a desired temperature and has passed through the filtration system 102 and/or treated liquid 124 and is suitable for multiple users to use without changing the water.

Figure 10:
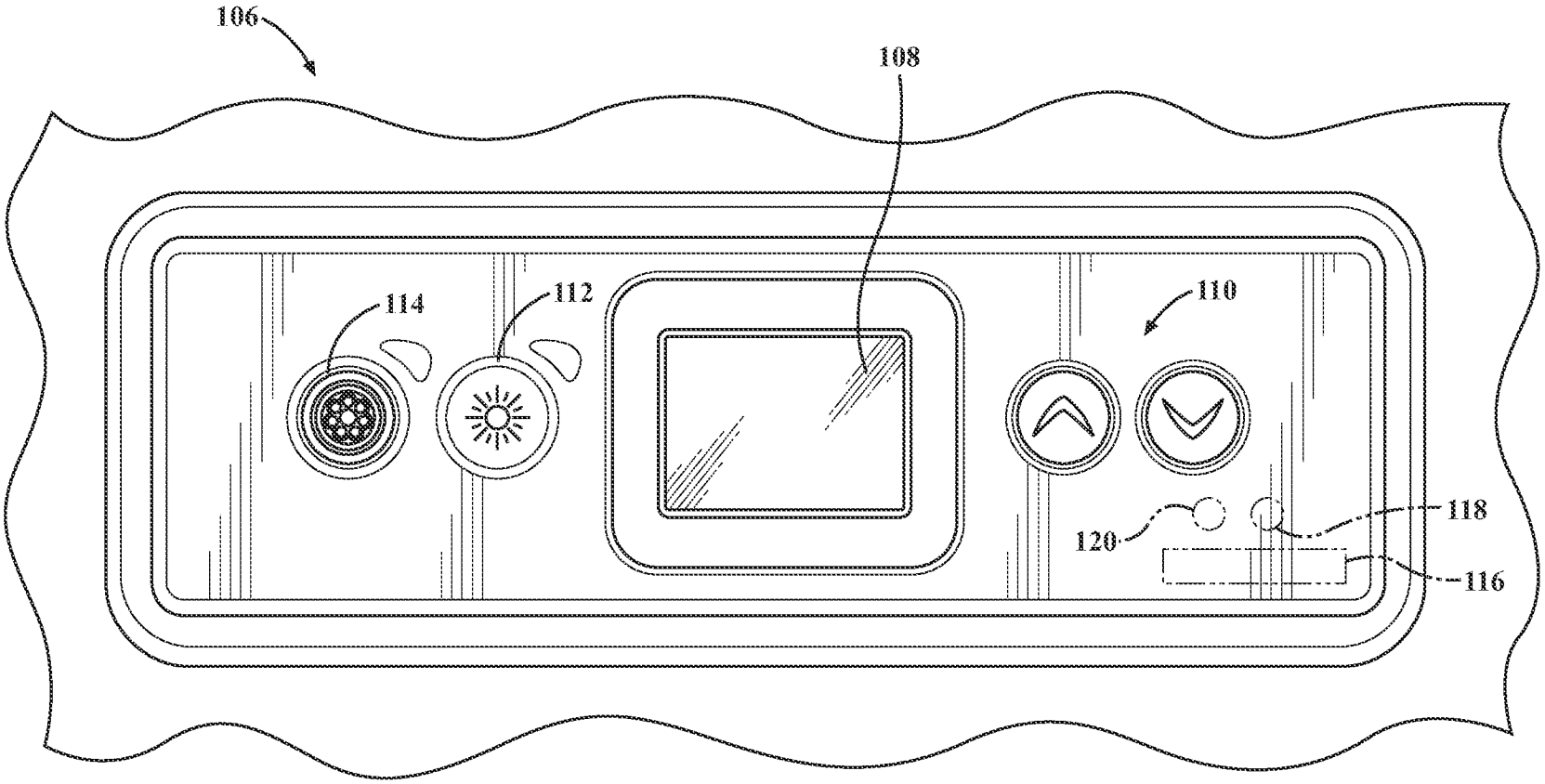
FIG. 10 schematically depicts an isolated view of a liquid treatment interface of the aquatic exercise equipment assembly of FIG. 1 according to one or more embodiments shown and described herein.

Now referring to FIG. 10, a liquid treatment interface 106 that includes an electronic control unit 116 is schematically depicted. The electronic control unit 116 is configured with logic modules 118 and a database 120 to perform the functions described herein. As such, the liquid treatment interface 106 and the electronic control unit 116 are communicatively coupled to the various components of the plurality of plumbing 100 (e.g., motors 122, valves, switches, filtration and treatment system 124, and/or the like).

The liquid treatment interface 106 includes a display portion 108 and provides customizable controls 110, 112, 114 to adjust the various functions of the plurality of plumbing 100. For example, a gallons per minute, liquid temperature, and filtration and treatment conditions may be adjusted via the liquid treatment interface 106. Further, pressure of the recirculating liquid may also be adjusted via the liquid treatment interface 106.

Now referring to FIGS. 14-17, a second aspect of an aquatic exercise equipment assembly 210 is schematically depicted. It is understood that the aquatic exercise equipment assembly 210 is similar to the aquatic exercise equipment assembly 10 of FIGS. 1-13 with the exceptions of the features described herein. As such, like features will use the same reference numerals with a prefix "2" for the reference numbers. As such, for brevity reasons, these features will not be described again.

The pedal assembly 240 includes a frame 264. The frame 264 includes a base member 302 and a flywheel receiving portion 303. The flywheel receiving portion 303 includes a pair of spaced apart arms 304 that are attached to a base portion 305 to form an opening 266 between the pair of spaced apart arms 304. In some embodiments, the pair of spaced apart arms 304 and the base are a monolithic structure. In other embodiments, the pair of spaced apart arms 304 are coupled to the base portion 305 via fasteners, such as bolt and nuts, screws, rivets, epoxy, adhesive, weld, and/or the like. Each of the pair of spaced apart arms 304 include a plurality of slots 306 that correspond to one another. In some embodiments, the plurality of slots 306 open in the vertical direction (i.e., in the +/−Z direction) at an upper surface 308 of the pair of spaced apart arms 304. In other embodiments, the plurality of slots 306 open in any direction.

Figure 15:
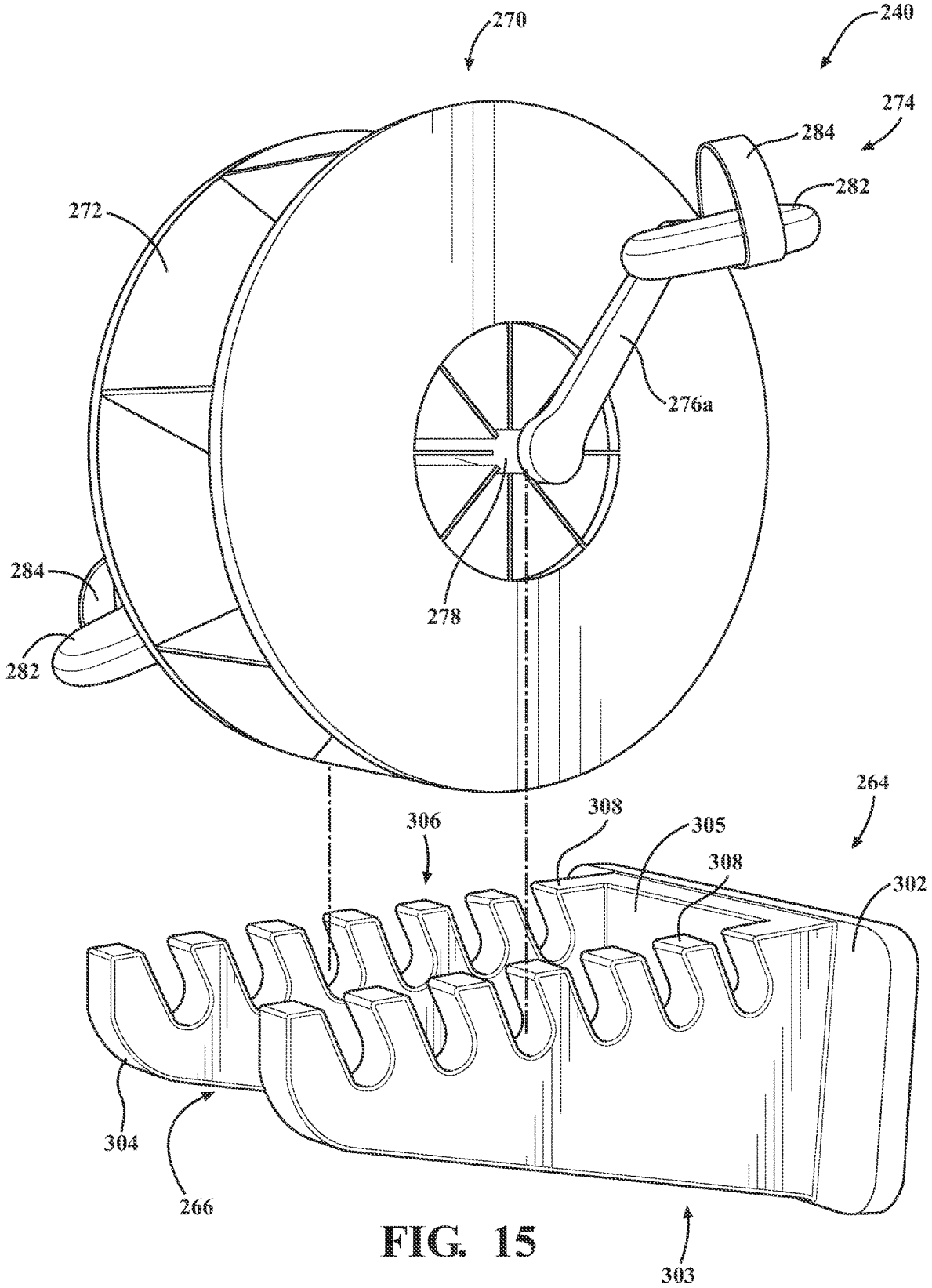
FIG. 15 schematically depicts an exploded isolated view of the second aspect of the pedal assembly of the aquatic exercise equipment assembly of FIG. 14 according to one or more embodiments shown and described herein.
Figure 16:
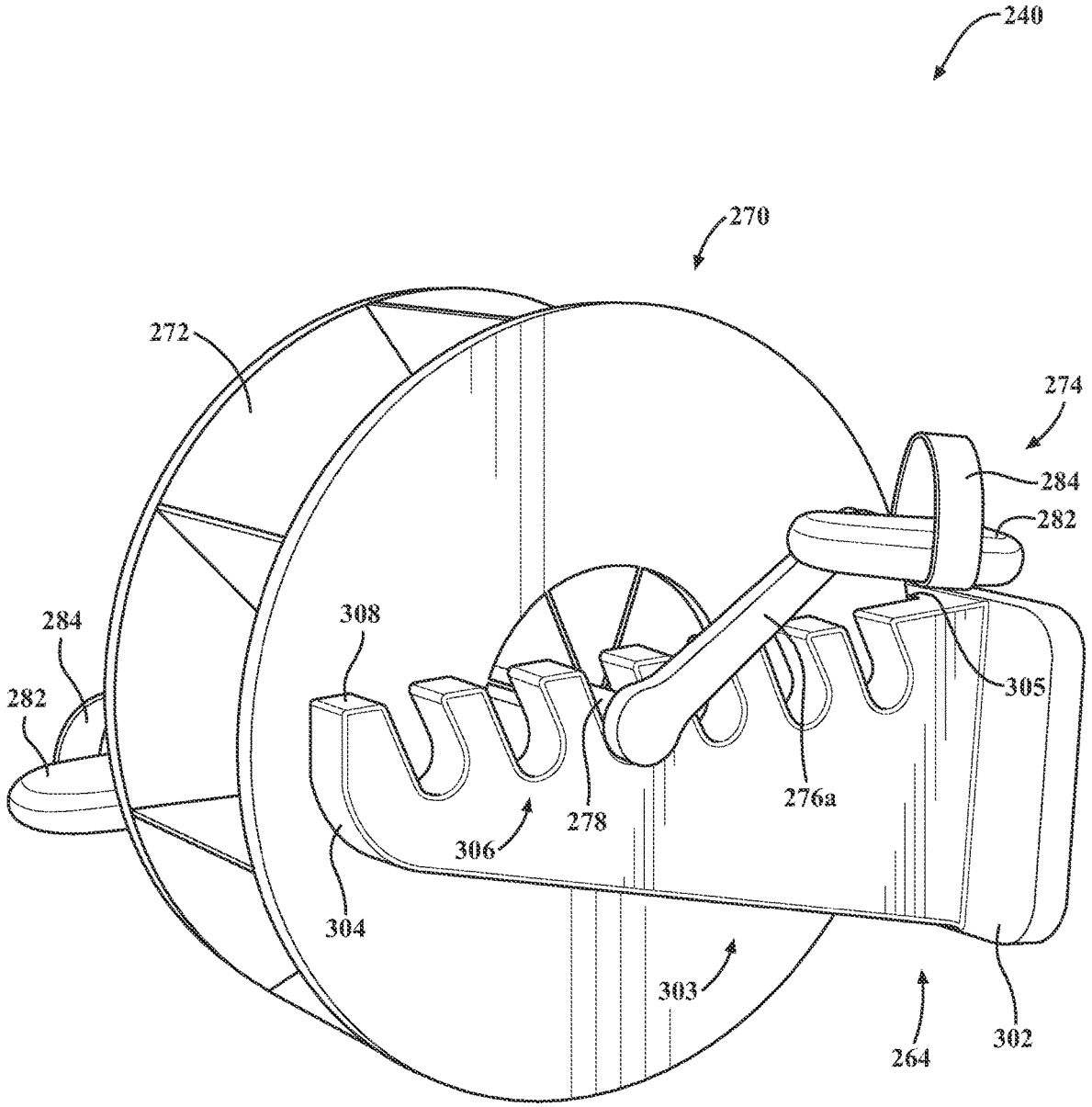
FIG. 16 schematically depicts an isolated view of the pedal assembly of FIG. 15 in an assembled state according to one or more embodiments shown and described herein.

Further, in some embodiments, the plurality of slots 306 are angled with respect to the upper surface 308 of the pair of spaced apart arms 304. In other embodiments, the plurality of slots 306 are not angled or are positioned in a vertical direction. In some embodiments, the plurality of slots 306 are generally depicted in FIGS. 15 and 16 as a "U" shape. This is non-limiting and the plurality of slots 306 may be any shape, such as an "L" shape, a "T" shape, and/or the like. Further, each slot of the plurality of slots 306 may be uniform in shape and size or may be different shapes and sizes.

In some embodiments, the frame 264 is mounted or coupled to the bottom wall 217 of the liquid retention portion 216. In this embodiment, the frame 264 is mounted or coupled to the bottom wall 217 of the liquid retention portion 216 via a fastener, such as a screw, nut and bolt, epoxy, and/or the like. In other embodiments, the frame 264 is mounted or coupled to the end wall 215*a* of the liquid retention portion 16. In this embodiment, the frame 64 is mounted or coupled to the end wall 215*a* of the liquid retention portion 216 via a fastener, such as a screw, nut and bolt, epoxy, and/or the like. In other embodiments, the frame 264 is mounted or coupled to the bottom wall 217 and the end wall 215*a* of the liquid retention portion 216. In this embodiment, the frame 264 is mounted or coupled to the bottom wall 217 and the end wall 215*a* of the liquid retention portion 216 via a fastener, such as a screw, nut and bolt, epoxy, and/or the like. In some embodiments, the frame 264 is mounted or coupled to the bottom wall 217 and/or the end wall 215*a* to be positioned above the bottom wall 217 in the vertical direction (i.e., in the +/−Z direction).

In some embodiments, the frame may be a metal. For example, the frame 264 may be a steel, iron, aluminum, aluminum alloy, and/or the like. As such, the frame 264 may be constructed with angle iron, unistrut, and/or the like. In other embodiments, the frame 264 may be a polymer, a resin, a fiberglass, and/or the like. The frame 264 includes a pedal receiving portions 268, as discussed in greater detail herein.

A flywheel 270 is rotatable coupled to the frame 264. The flywheel 270 is positioned to rotate with respect to the frame 264 and a portion of the flywheel 270 may move through the opening 266 of the frame 264. The flywheel 270 includes a plurality of liquid receiving depressions 272 or cups that is configured to create a resistance when the flywheel 270 is rotated or moved through the liquid and held within the liquid retention portion 216, as discussed in greater detail herein. Further, in some embodiments, the entire flywheel 270 is submersed below a liquid level. In other embodiments, a portion of the flywheel 270 is positioned above a liquid level such that portions of the flywheel 270 is submerged within the liquid while other portions are not submerged or position above a liquid level.

In some embodiments, the flywheel 270 may be constructed with a metal material. For example, the flywheel 270 may be a steel, iron, aluminum, aluminum alloy, and/or the like. As such, the flywheel 270 may be constructed with angle iron, unistrut, and/or the like. In other embodiments, the flywheel 70 may be a polymer, a resin, a fiberglass, and/or the like.

Figure 14:
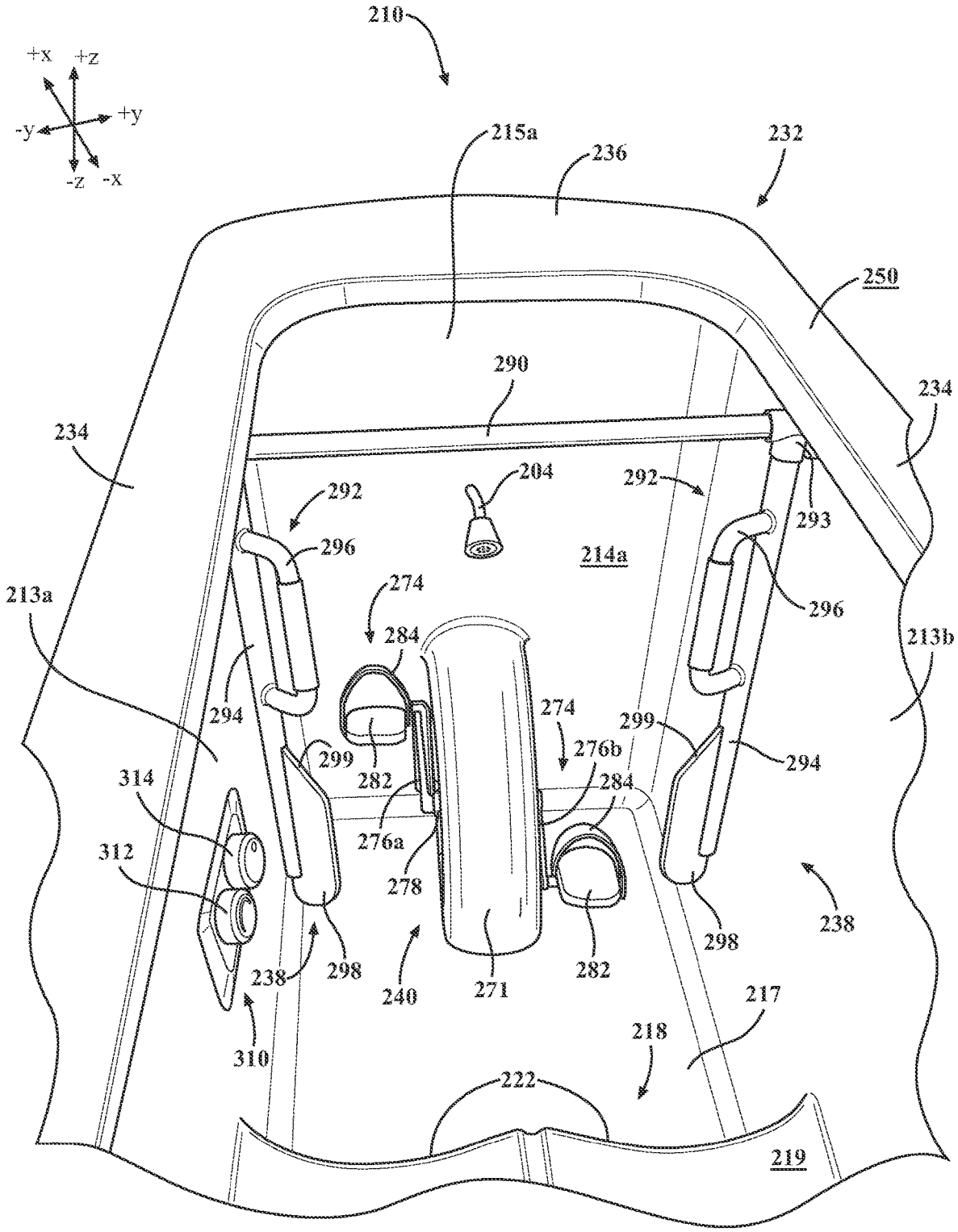
FIG. 14 schematically depicts an isolated view of a second aspect of an aquatic exercise equipment assembly of FIG. 1 with a second aspect of a rudder assembly and a second aspect of a pedal assembly of the aquatic exercise equipment assembly of FIG. 1 in a neutral positon according to one or more embodiments shown and described herein.

Still referring to FIGS. 14-16, the pair of pedals 274 are rotatable coupled to the pair of pedal arms 276*a*, 276*b*. The pedal arms 276*a*, 276*b* are coupled to a drive shaft 278 that extends in the lateral direction (i.e., in the +/−Y direction) to connect to each of the pedal arms 276*a*, 276*b* and the flywheel 270. That is, in some embodiments, the drive shaft 278 is coupled directly to each of the pedal arms 276*a*, 276*b*. In some embodiments, the drive shaft 278 is coupled directly to each of the pedal arms 276*a*, 276*b* via welding, adhesive, epoxy, a fastener, such as a screw, rivet, bolt and nut, and/or the like. As such, the drive shaft 278 and the flywheel 270 may rotate directly by the rotation of the pedal arms 276*a*, 276*b*.

Further, the drive shaft 278 is rotatably positioned within at least two of the plurality of slots 306, one on each of the pair of spaced apart arms 304. As such, the position of the flywheel 270, the pedal arms 276*a*, 276*b* and/or the pedals 274 are adjustable in the longitudinal direction (i.e., in the +/−X direction). As such, the pedal assembly 240 is adjustable between the plurality of slots 306 to fit different leg lengths of the user 226.

In some embodiments, the pedal arms 276*a*, 276*b* and the drive shaft 278 may be constructed with a metal. For example, the pedal arms 276*a*, 276*b* and the drive shaft 278 may, individually or together, be a steel, iron, aluminum, aluminum alloy, and/or the like. In other embodiments, the pedal arms 276*a*, 276*b* and the drive shaft 278, individually or together, may be a polymer, a resin, a fiberglass, and/or the like.

Still referring to FIGS. 14-16, each of the pair of pedals 274 include a footrest portion 282 and a foot retention portion 284. The footrest portion 282 may be a planer surface that receives a bottom surface 288*a* of a foot 286 of the user 226. The foot retention portion 284 is coupled to each side of the footrest portion 282 to retain an upper surface 288*b* of the foot 286. That is, the foot retention portion 284 assists in retaining the bottom surface 288*a* of the foot 286 of the user 226 against the footrest portion 282. The foot retention portion 84 may be adjustable between the various users 226.

In some embodiments, the pair of pedals 274 may each be constructed with a metal such as a steel, an aluminum, an aluminum allow, and/or the like. In other embodiments, the pair of pedals 274 may each be constructed with a polymer, resin, fiberglass, and/or the like. Further, in some embodiments, the foot retention portion 284 may be constructed with a flexible, resilient material, such as a polymer, fabric, nylon, plastic, and/or the like.

Now referring to FIG. 14, the paddle assembly 238 includes a cross member 290, a pair of movable paddles 292 that are movable between a forward and rearward position in the longitudinal direction (i.e., in the +/−X direction), and a pair of receiving portions 293. Each of the receiving portions 293 include portions to receive both the cross member 290 and one of the pair of movable paddles 292. In some embodiments, each of the receiving portions 293 are a monolithic structure formed with the pair of sidewalls 213*a*, 213*b*. In other embodiments, each of the receiving portions 293 are attached or coupled to one of the pair of sidewalls 213*a*, 213*b*, respectively. Each of the receiving portions 293 are also positioned below the cover 232 in the vertical direction (i.e., in the +/−Z direction).

Still referring to FIG. 14, the pair of movable paddles 292 are each positioned adjacent to opposite sidewalls 213*a*, 213*b* and are each coupled or attached to one of the receiving portions 293 respectively. Each of the pair of movable paddles 292 include an elongated member 294, a handle portion 296, and rudder portion 298. The elongated member 294 of each of the pair of movable paddles 292 extends generally in the vertical direction (i.e., in the +/−Z direction). The handle portion 296 is positioned above the rudder portion 298 in the vertical direction (i.e., in the +/−Z direction).

In some embodiments, both the handle portion 296 and the rudder portion 298 are coupled or attached to the elongated member 294 via fasteners such as bolts and nuts, rivets, screws, welded, epoxy, adhesive, and/or the like. In other embodiments, the handle portion 296 is formed as a monolithic structure with the elongated member 294. In some embodiments, the handle portion 296 is generally a U-shape that, along with the elongated member 294, form an enclosed handle portion that allows for multiple grip positions for the user 226. As such, in some embodiments, portions of the elongated member 294 and/or the handle portion 296 may be textured or padded to provide additional grip and/or comfort to the user 226. The handle portion 296 is submersed within the liquid of the liquid retention portion 216.

In other embodiments, the elongated member 94 may include a slot extending from a distal end opposite of the proximate end, which is coupled to one of the receiving portions 293. The rudder portion 298 is received in the slot to hold or position the rudder portion 298 below the handle portion 296 in the vertical direction (i.e., in the +/−Z direction). Further, a fastener may couple the rudder portion 298 to the slot, such as, rivets, screws, bolt and nuts, epoxy, adhesive, and the like.

Still referring to FIG. 14, the rudder portion 298 is a flap that extends inwardly in the lateral direction (i.e., in the +/−Y direction) from the elongated member 294 to provide a resistance upon a movement of each of the pair of movable paddles 292. That is, the rudder portion 298 extends away from one of the pair of sidewalls 213*a*, 213*b* towards the other one of the pair of sidewalls 213*a*, 213*b*. In some embodiments, the rudder portion 298 is an arcuate shaped flap in the longitudinal direction (i.e., in the +/−X direction) so to move more liquid within the liquid retention portion 16. That is, the rudder portion 298 may have an arcuate or curve that changes the resistance of the pair of movable paddles 292 when moved through the liquid, as discussed in greater detail herein.

Further, the rudder portion 298 may be a plurality of different shapes. For example, the rudder portion 298 may be a uniform length or may include at least one tapered portion 299, as best illustrated in FIG. 16. In some embodiments, the entire rudder of the rudder portion 298 is submersed below the liquid level in the liquid retention portion 216. In other embodiments, rudder portion 298 is submersed below the liquid level in the liquid retention portion 216. As such, it should be appreciated that the amount of drag or resistance created by the rudder portion 298 may vary based on the size and shape of the rudder portion 298 as well as the amount of the rudder portion 298 that is in contact with the liquid retained within the liquid retention portion 216.

Still referring to FIG. 14, a user interface 310 that is communicatively coupled to the electronic control unit 116 (FIG. 10) is schematically depicted. The user interface 310 includes a controls to provide a customized experience to the user 226. For example, the user interface 310 may include a heat control 312 and a liquid recirculating control 314. Each of the controls 312, 314 may be knobs that the user can rotate to adjust to a desired setting. In other embodiments, the user interface 310 may be switches, an electronic display, and/or the like. When the user makes an adjustment via one of the controls 312, 314, the electronic control unit 116 (FIG. 10) adjusts the various functions of the plurality of plumbing 100 to accommodate for such adjustments. For example, a gallons per minute, a liquid temperature may be adjusted via the user interface 310.

Figure 17:
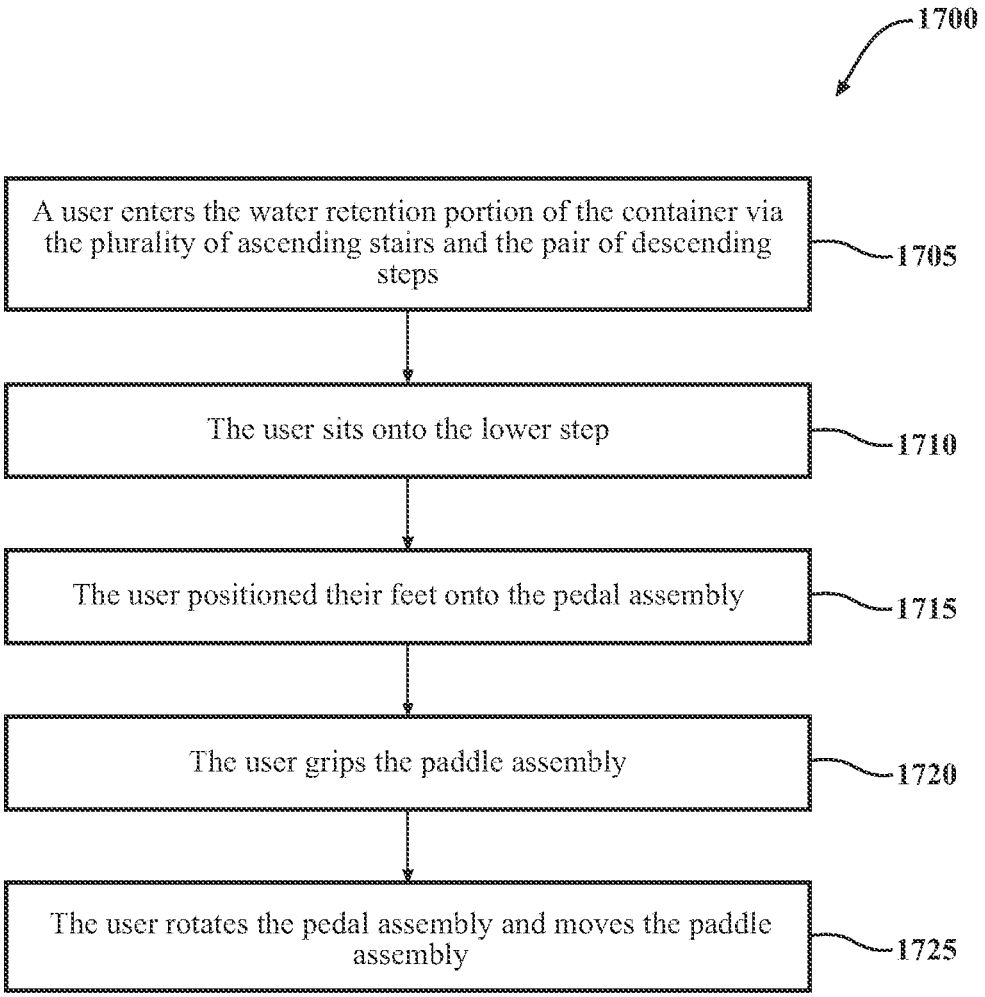
FIG. 17 schematically depicts a flowchart of an illustrative method for using the aquatic exercise equipment assembly of FIG. 1 according to one or more embodiments shown and described herein.

Referring now to FIG. 17, a flow diagram that graphically depicts an illustrative method 1400 of using the aquatic exercise equipment assembly is provided. Although the steps associated with the blocks of FIG. 17 will be described as being separate tasks, in other embodiments, the blocks may be combined or omitted. Further, in other embodiments, the steps may be performed in a different order.

At block 1705, a user enters the liquid retention portion of the container via the plurality of ascending stairs and the pair of descending steps. The hand rails may be utilized by the user to assist the user in navigating the plurality of ascending stairs and the cross member may assist the user in navigating the pair of descending steps. At block 1710, the user sits onto the lower step. The user may also position a portion of their back into the arcuate portion of the upper step of the pair of descending steps.

At block 1715 the user positioned their feet onto the pedal assembly. That is, the user may position their feet onto the footrest portion of the pair of pedals and adjust foot retention portion to assist in maintain their feet onto the footrest portion. At block 1720, the user grips the paddle assembly. That is, the user may grip the paddle assembly at the handle portion.

At block 1725, the user rotates the pedal assembly and moves the paddle assembly. The user may rotate the pedal assembly via using their legs to apply a pressure onto the pair of pedals which rotates the drive shaft and the flywheel. The user using a forward and rearward motion to move the paddle assembly between an extended position and a retracting portion in the longitudinal direction (i.e., in the +/−X direction). As such, the paddle assembly is for an upper body movement and the pedal assembly is for a lower body movement. It should be appreciated that the resistance of paddle assembly and the pedal assembly is caused from the resistance of the liquid within the liquid retention portion. Moreover, it should be understood that the paddle assembly and the pedal assembly assist users through controlled ranges of motion or specific movements that are desirable for each user.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An aquatic exercising assembly comprising:

a container having a liquid retention portion, the liquid retention portion having:

a bottom wall, a pair of opposing sidewalls, and a pair of opposing end walls;

a flywheel having a plurality of liquid receiving depressions and a drive shaft;

a frame having a plurality of slots configured to receive the drive shaft of the flywheel such that the flywheel is adjustable along between the plurality of slots of the frame, wherein when the flywheel is rotated, the plurality of liquid receiving depressions interact with a fluid provided within the liquid retention portion to provide a resistance.

2. The aquatic exercising assembly of claim 1, wherein the flywheel further comprises:

a pair of pedals rotatable coupled to a pair of pedal arms, the pair of pedal arms mechanically coupled to the flywheel.

3. The aquatic exercising assembly of claim 2, wherein the drive shaft is coupled to the pair of pedal arms such that a rotation of the pair of pedals rotate the drive shaft and the flywheel.

4. The aquatic exercising assembly of claim 3, wherein the flywheel is rotatably moved by a lower body movement of a user.

5. The aquatic exercising assembly of claim 1, wherein the flywheel is submersed below a liquid level in the liquid retention portion.

6. The aquatic exercising assembly of claim 1, wherein the flywheel is partially submerged below a liquid level in the liquid retention portion.

7. The aquatic exercising assembly of claim 1, wherein the flywheel further comprises:

a cover that at least partially encloses the flywheel.

8. The aquatic exercising assembly of claim 7, wherein the cover extends from the end wall.

9. The aquatic exercising assembly of claim 7, wherein the cover is a monolithic structure with the end wall.

10. The aquatic exercising assembly of claim 7, wherein the cover is removably coupled to the end wall.

11. An aquatic exercising assembly comprising:

a container having a liquid retention portion having:

a bottom wall, a pair of opposing sidewalls, and a pair of opposing end walls;

a pedal assembly rotatably coupled to at least one of the walls, the pedal assembly including:

a flywheel having a drive shaft and a plurality of liquid receiving depressions, the plurality of liquid receiving depressions interact with a fluid provided within the liquid retention portion to provide a resistance; and a frame having a plurality of slots configured to receive the drive shaft of the flywheel such that the flywheel is adjustable along between the plurality of slots of the frame, wherein the pedal assembly is rotatably moved by a lower body movement of a user.

12. The aquatic exercising assembly of claim 11, wherein the pedal assembly further comprises:

a pair of pedals rotatable coupled to a pair of pedal arms, the pair of pedal arms mechanically coupled to the flywheel.

13. The aquatic exercising assembly of claim 12, wherein the drive shaft is coupled to the pair of pedal arms and to the flywheel such that a rotation of the pair of pedals rotate the drive shaft and the flywheel.

14. The aquatic exercising assembly of claim 11, wherein the flywheel is submersed below a liquid level in the liquid retention portion.

15. The aquatic exercising assembly of claim 11, wherein the flywheel is partially submerged below a liquid level in the liquid retention portion.

16. The aquatic exercising assembly of claim 11, wherein the pedal assembly further comprises:

a cover that at least partially encloses the flywheel.

17. The aquatic exercising assembly of claim 16, wherein the cover extends from the end wall.

18. The aquatic exercising assembly of claim 16, wherein the cover is a monolithic structure with the end wall.

19. The aquatic exercising assembly of claim 16, wherein the cover is removably coupled to the end wall.

* * * * *